US009823021B2

(12) United States Patent
Chan et al.

(10) Patent No.: US 9,823,021 B2
(45) Date of Patent: Nov. 21, 2017

(54) METHODS AND SYSTEMS FOR COOLING HOT PARTICULATES

(71) Applicants: Iwan H. Chan, Houston, TX (US); Yongchao Li, Katy, TX (US)

(72) Inventors: Iwan H. Chan, Houston, TX (US); Yongchao Li, Katy, TX (US)

(73) Assignee: Kellogg Brown + Root LLC, Houston, TX (US)

( * ) Notice: Subject to any disclaimer, the term of this patent is extended or adjusted under 35 U.S.C. 154(b) by 1006 days.

(21) Appl. No.: 14/135,680

(22) Filed: Dec. 20, 2013

(65) Prior Publication Data

US 2015/0176910 A1 Jun. 25, 2015

(51) Int. Cl.

| | |
|---|---|
| ***F28D 13/00*** | (2006.01) |
| ***F28D 7/12*** | (2006.01) |
| ***F28D 1/02*** | (2006.01) |
| ***C10J 3/00*** | (2006.01) |

(52) U.S. Cl.

CPC *F28D 1/02* (2013.01); *C10J 3/00* (2013.01); *F28D 7/12* (2013.01); *F28D 13/00* (2013.01); *C10J 2300/1628* (2013.01)

(58) Field of Classification Search

CPC ..... F28D 13/00; F28D 7/12
USPC ..... 165/142
See application file for complete search history.

(56) References Cited

U.S. PATENT DOCUMENTS 2,628,965 A 2/1953 Sullivan, Jr.
3,174,834 A 3/1965 Edwards et al.
3,887,003 A 6/1975 Polcer et al.
4,140,172 A 2/1979 Corey
4,142,580 A 3/1979 Bailey
4,176,710 A 12/1979 Gansauge et al.
4,431,049 A 2/1984 Zamma et al.
4,548,257 A 10/1985 Williamson
4,881,592 A * 11/1989 Cetinkaya ..... B01J 8/0055 165/104.16
5,209,287 A * 5/1993 Johnson ..... B01J 8/1836 165/104.16
5,415,673 A 5/1995 Hilton et al.
5,773,379 A * 6/1998 Bonifay ..... B01J 8/082 208/113
5,954,000 A 9/1999 Panos
6,086,722 A 7/2000 Webster, Jr. et al.
6,994,497 B1 * 2/2006 Eriksson ..... B01J 8/0005 406/124

(Continued)

*Primary Examiner* — Matthew J Merkling
(74) *Attorney, Agent, or Firm* — Gary Machetta

(57) ABSTRACT

Methods, systems, and apparatus for cooling particulates are provided. A method can include introducing particulates and water to a first vessel to provide a fluidized bed of particulates and cooling the fluidized bed of particulates in the first vessel to obtain first cooled particulates. The method can also include recovering the first cooled particulates from the first vessel and introducing the first cooled particulates to a heat exchanger comprising a plurality of tubulars. The method can also include introducing a coolant to the plurality of tubulars, flowing the first cooled particulates through a shell side of the heat exchanger and contacting at least a portion of the first cooled particulates with the plurality of tubulars, recovering a heated coolant from the plurality of tubulars, and recovering second cooled particulates from a particulate outlet.

18 Claims, 8 Drawing Sheets

(56) References Cited

U.S. PATENT DOCUMENTS

| | | | | |
|---|---|---|---|---|
| 7,565,669 | B2 | 7/2009 | Kim et al. | |
| 8,002,855 | B2 | 8/2011 | Koehler et al. | |
| 2006/0165582 | A1 | 7/2006 | Brooker et al. | |
| 2007/0283902 | A1* | 12/2007 | Maryamchik | F23C 10/18 122/4 D |
| 2008/0250714 | A1 | 10/2008 | Palonen et al. | |
| 2009/0114352 | A1 | 5/2009 | Rossi | |
| 2009/0188165 | A1 | 7/2009 | Ariyapadi et al. | |
| 2009/0253956 | A1 | 10/2009 | Fujita | |
| 2010/0040527 | A1 | 2/2010 | Randhava et al. | |
| 2012/0031584 | A1 | 9/2012 | Vimalchand et al. | |
| 2013/0312946 | A1 | 11/2013 | Chan et al. | |
| 2014/0311031 | A1* | 10/2014 | Winter | C10J 3/72 48/101 |
| 2015/0196885 | A1* | 7/2015 | Chan | B01J 19/0013 165/104.14 |

* cited by examiner

METHODS AND SYSTEMS FOR COOLING HOT PARTICULATES

CROSS-REFERENCE TO RELATED APPLICATIONS

This application is a continuation-in-part of U.S. patent application having Ser. No. 13/480,265, filed on May 24, 2012, which is incorporated by reference herein.

BACKGROUND

Field

Embodiments described herein generally relate to the gasification of hydrocarbons. More particularly, such embodiments relate to cooling particulates recovered from a gasification process.

Description of the Related Art

Raw synthesis gas leaving a gasifier can contain particulates such as coarse ash, fine ash, and/or slag that need to be removed prior to further processing. The bulk of the particulates can be removed using a particulate removal system such as filters and/or cyclones. The removed particulates are typically recycled to the gasifier or purged from the system as a byproduct, and the syngas leaving the particulate removal system is further processed and/or purified. The removed particulates, however, typically require cooling before being recycled or purged from the system.

One method for cooling the removed particulates is to drop the hot particulates into a vessel of water and the cooled particulates are then separated from the "dirty" water. This method is not very efficient and only works at low pressures. Another method is to feed the hot particulates to a large horizontally oriented, fluidized bed having cooling coils disposed therein. A large fluidized bed, however, is not easily expanded or contracted to meet the typical cooling requirements of the system. It can also require high energy input to keep particulates flowing through the fluidized bed. And if a portion of the fluidized bed malfunctions, the entire gasification process might have to slow or come to a halt until the fluidized bed cooler can be repaired. Yet another method is to feed the hot particulates to a vessel containing coiled cooling tubes. These tubes, however, can succumb to the thermal stresses caused by the high temperatures of the hot particulates. Also tube expansion or contraction can exist when particulate temperature changes due to varying heat load. The tube expansion or contraction can lead to thermal stress causing cracks or other damage to the cooling tubes, which could require a halt to the entire gasification process to repair the cooler.

There is a need, therefore, for new apparatus, systems, and methods for cooling particulates recovered from a gasification process.

SUMMARY

A method for cooling particulates is disclosed. The method can include introducing particulates and water to a first vessel to provide a fluidized bed of particulates and cooling the fluidized bed of particulates in the first vessel to obtain first cooled particulates. The method can also include recovering the first cooled particulates from the first vessel and introducing the first cooled particulates to a heat exchanger comprising a plurality of tubulars. The method can also include introducing a coolant to the plurality of tubulars, flowing the first cooled particulates through a shell side of the heat exchanger and contacting at least a portion of the first cooled particulates with the plurality of tubulars, recovering a heated coolant from the plurality of tubulars, and recovering second cooled particulates from a particulate outlet.

Another method for cooling particulates is also disclosed. The method can include gasifying a carbonaceous material in the presence of one or more oxidants to provide ash and a raw synthesis gas comprising hydrogen and carbon monoxide, introducing at least a portion of the ash and water to a first vessel to provide a first dense bed of particulates, and cooling the first dense bed of particulates in the first vessel to obtain first cooled particulates. The method can also include recovering the first cooled particulates from the first vessel and introducing at least a portion of the first cooled particulates to a second vessel comprising an elongated shell having a first end, a second end, and one or more sidewalls, wherein the first cooled particulates are introduced through a particulate inlet disposed in the one or more sidewalls and second cooled particulates exit the second vessel through a particulate outlet disposed on the second end. The method can also include introducing a coolant to a tube bundle disposed within the second vessel, wherein the tube bundle comprises a plurality of tubulars, wherein the tubulars each have an open first end secured to a first tube sheet and a closed second end, wherein an inner conduit is concentrically placed within each of the tubulars, wherein the inner conduit has an open first end secured to a second tube sheet and an open second end disposed adjacent the closed second end, and wherein the coolant enters the tube bundle through a coolant inlet adjacent the first end. The method can also include recovering a heated coolant from a coolant outlet disposed in the one or more sidewalls between the first tube sheet and the second tube sheet for discharging the heated coolant and flowing the first cooled particulates through a shell side of the vessel resulting in a second dense bed of particulates and contacting the second dense bed of particulates with the tube bundle. The method can also include introducing an aeration gas into the vessel from one or more aeration nozzles located within the second vessel between the second end and the tube bundle, wherein the aeration gas is directed toward the tube bundle, venting at least a portion of the aeration gas via an aeration gas vent line disposed on the one or more sidewalls at a location between the particulate inlet and the first tube sheet, and recovering second cooled particulates from the particulate outlet disposed on the second end of the second vessel.

A system for cooling particulates is also disclosed. The system can include a gasifier in fluid communication with a raw syngas line and a particulate removal line, a first vessel in fluid communication with the particulate removal line, the first vessel comprising one or more water injection nozzles and one or more first aeration nozzles, and a particulate transfer line in fluid communication with the first vessel and a second vessel. The second vessel can include an elongated shell having a first end, a second end, and one or more sidewalls, a shell side particulate inlet in fluid communication with the particulate transfer line and disposed in the one or more sidewalls for receiving particulates and a shell side particulate outlet disposed adjacent the second end for discharging cooled particulates, wherein a narrowing member is situated between the second end and the particulate outlet. The second vessel can also include a tube side fluid inlet adjacent the first end for receiving a coolant, a tube bundle comprising a plurality of tubulars, wherein the tubulars each have an open first end secured to a first tube sheet and a closed second end, and wherein an inner conduit is concentrically placed within each of the tubulars, the inner conduit having an open first end secured to a second tube sheet and an open second end disposed adjacent to the closed second end, and a coolant outlet disposed in the one or more sidewalls between the first tube sheet and the second tube sheet for discharging heated coolant and a coolant inlet disposed adjacent to the first end for receiving coolant. The second vessel can also include one or more second aeration nozzles disposed between the second end or the vessel and the tube bundle for directing a second aeration fluid toward the tube bundle and one or more third aeration nozzles disposed on a sidewall of the narrowing member for directing a third aeration gas toward the particulate outlet.

DETAILED DESCRIPTION

Figure 1:
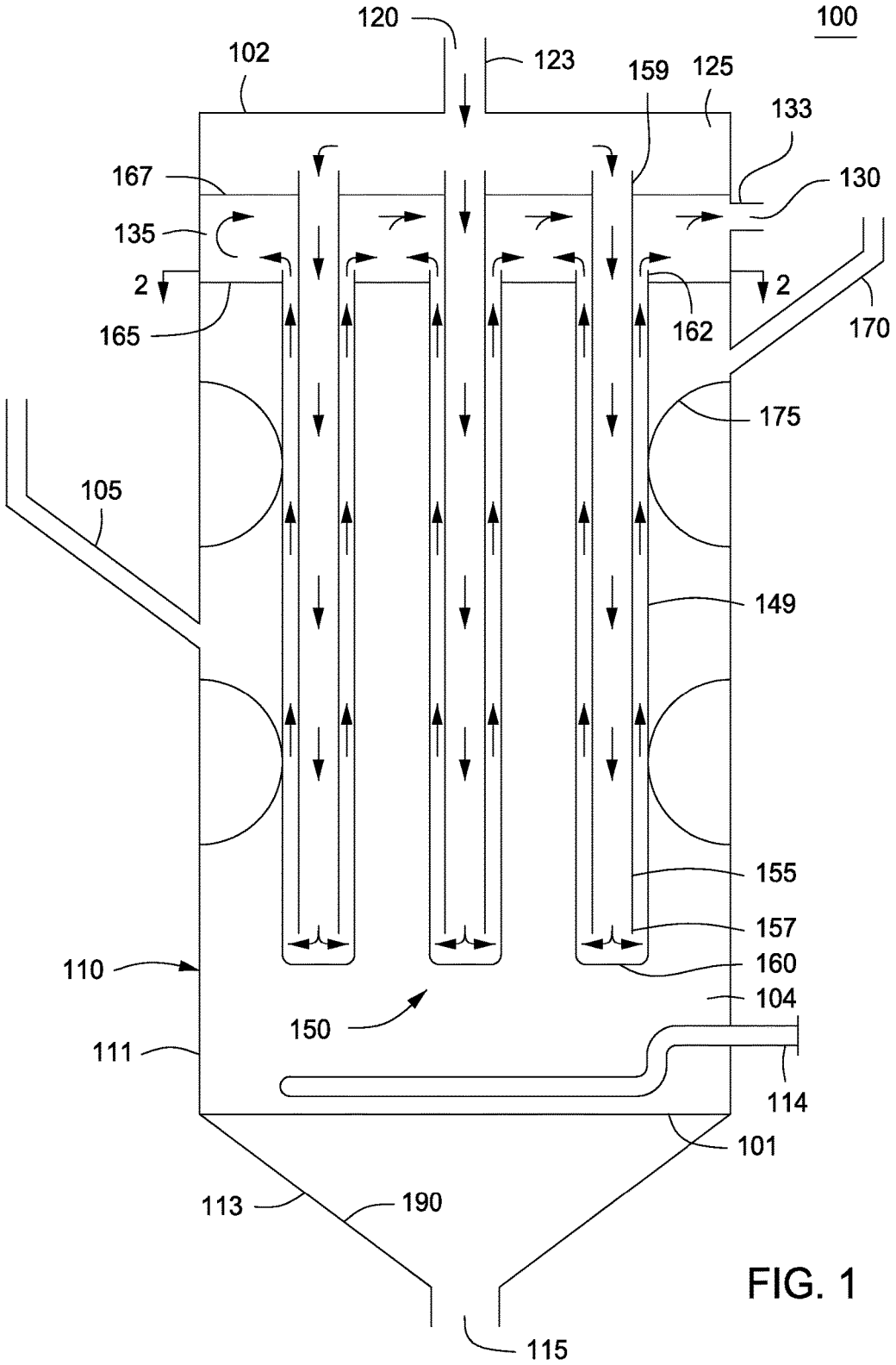
FIG. 1 depicts a cross-sectional side view of an illustrative heat exchanger, according to one or more embodiments described.

FIG. 1 depicts a cross-sectional view of an illustrative heat exchanger 100, according to one or more embodiments. The heat exchanger 100 can include a housing 110, one or more inlet manifolds 125, one or more outlet manifolds 135, and one or more heat exchange members or tubulars 149. The heat exchanger 100 can further include a plurality of tubulars 149 to form or provide a tube bundle 150. The inlet manifold 125, outlet manifold 135, and the tube bundle 150 can be or form, at least in part, a "tube side" of the heat exchanger 100, while the remaining interior volume or housing interior 104 can be or form, at least in part, a "shell side" of the heat exchanger 100.

The housing 110 can be a single component or structure or can be made of two or more components or structures assembled together. The housing 110 can have a first or "top" end 102 and a second or "bottom" end 101. The housing 110 can include a particulate inlet 105, a particulate outlet 115, and a vent gas outlet 170. The particulate inlet 105 can be disposed on the housing 110 between the first end 102 and the second end 101. For example, the particulate inlet 105 can be in fluid communication with the interior volume 104 near the lower half of the tube bundle 150 such that a dense bed of particulates can be formed within the interior volume 104 between the second end 101 and the particulate inlet 105, and a dilute phase of particulates can be formed between a surface of the dense bed and the second end 102 of the heat exchanger 100. The bottom end 101 and the particulate outlet 115 can be joined together by a tapered section or narrowing member 113. Said another way, the narrowing member 113 can have an inner surface that tapers or narrows from a first cross-sectional area at the bottom end 101 to the particulate outlet 115. For example, the narrowing member 113 can have a frustoconical or cone shaped inner surface or wall 190. One or more aeration nozzles 114 can be disposed at or near the bottom end 101 of the housing 110 in order to direct air in any direction toward the tube bundle 150.

The housing 110 can also include one or more inlets 120 and one or more outlets 130 disposed through one or more sidewalls (one is shown 111) and/or the top end 102 of the housing 110. The outlet 130 can be disposed through the sidewall 111, and the inlet 120 can be disposed through a top section placed or located on the upper end of the housing 110. The inlet or "coolant inlet" 120 can be connected to a coolant supply (not shown) and configured or adapted to receive coolant therethrough. For example, cold water can be supplied to the inlet 120 from a cold water source, another heat exchanger, or a combination thereof. Suitable coolants can include, but are not limited to, water, air, liquid hydrocarbons, gaseous hydrocarbons, or any combination thereof. Heated coolant can be recovered via the outlet or "coolant outlet" 130. For example, heated water can flow through the outlet 130 to one or more steam drums, economizers, or the like (not shown). In one or more embodiments, the coolant can enter the inlet 120, be distributed to the tube bundle 150, and exit the outlet 130 without the need for pumps or other transport equipment. For example, the coolant can enter the inlet 120, be distributed to the tube bundle 150, and exit the outlet 130 via the force of gravity alone. The coolant can be or serve as a cooling medium and/or as a heating medium. As such, the heat exchanger 100 can operate as a particulate cooler and/or a particulate heater.

The housing 110 can have any desired shape. For example, the housing 110 can be in the form or a cube, a rectangular box, a cylinder, a triangular prism, a hyperboloid structure, or some other shape or combination thereof. The housing 110 can also be cylindrical. The housing 110 can be oriented vertically or substantially vertically. For example, a substantially vertical housing 110 can be at an angle of about −20 degrees to about 20 degrees, about −15 degrees to about 15 degrees, about −10 degrees to about 10 degrees, about −5 degrees to about 5 degrees, about −3 degrees to about 3 degrees, about −2 degrees to about 2 degrees, about −1 degree to about 1 degree, about −0.1 degree to about 0.1 degree, about −0.01 degree to about 0.01 degree, about −0.001 degree to about 0.001 degree, or about −0.0001 degree to about 0.0001 degree with respect to a vertical.

The inlet manifold 125 can be at least partially disposed within the housing 110 and in fluid communication with the inlet 120. For example, the inlet manifold 125 can be joined to or in fluid communication with the inlet 120 via an inlet tube or inlet pipe 123. The outlet manifold 135 can also be at least partially disposed within the housing 110 and can be in fluid communication with the outlet 130. For example, the outlet manifold 135 can be joined to the outlet 130 via an outlet tube or outlet pipe 133. The inlet manifold 125 and the outlet manifold 135 can each be disposed above the one or more heat exchange members or tubulars 149. The inlet manifold 125 can be positioned above the outlet manifold 135, as shown. Alternatively, the inlet manifold 125 can be positioned within the outlet manifold 135 (not shown).

The tube bundle 150 can be at least partially disposed within the housing 110 and can be in fluid communication with the inlet and outlet manifolds 125, 135. The tube bundle 150 can be disposed at least partially below the inlet and/or outlet manifolds 125, 135. For example, the tube bundle 150 can be disposed beneath the inlet and outlet manifolds 125, 135 and between the sidewalls 111. The weight of tubulars 149 can be at least partially supported by the one or more outlet manifolds 135.

The tube bundle 150 can be supported by one or more support members or one or more tube sheets (one is shown, 165). One or more first tube sheets 165 can be positioned at any point near the open proximal end 162 of each tubular 149. At least a portion of the proximal end 162 of the tubulars 149 can be positioned above the first tube sheet 165. The first tube sheet 165 can be connected to or integral with the outer surface of each of the tubulars 149. The first tube sheet 165 can be connected to the tubulars 149 in any manner sufficient to support at least the entire weight of the tube bundle 150. The tubulars 149 can be free hanging and entirely supported by the first tube sheet 165. The first tube sheet 165 can be sealably secured to the inner surface 112 (see FIG. 2) of the sidewall 111 of the housing 110 and the outer surfaces of each of the tubulars 149. The first tube sheet 165 can create a fluid tight seal with the housing interior 104 and the outlet manifold 135 thus forming part of the outlet manifold 135. One or more stabilizers 175 can be included to reduce or prevent vibration of the free hanging tubulars 149. Any number of stabilizers 175 can be included. Each tubular 149 can be in contact with at least one stabilizer 175, at least 2 stabilizers, or 3 or more stabilizers. For example, the number of stabilizers 175 that can be in contact with one or more of the tubulars 149 can range from a low of about 1, about 2, or about 3 to a high of about 5, about 7, or about 10.

The tubulars 149 can have an enclosed distal end 160 and an open proximal end 162. The open proximal end 162 can be coupled to the inlet manifold 125. The tubulars 149 can be axially oriented with respect to a longitudinal axis of the housing 110 and/or can be substantially straight. The substantially straight length of the tubulars 149 can be optimized to reduce or avoid vibration and/or to facilitate maintenance of the tubulars 149. For example, the straight length of the tubulars 149 can range from a low of about 1 meter to a high of about 20 meters. Any number of tubulars 149 can be included in the tube bundle 150. For example, 2, 3, 4, 6, 8, 10, 14, 16, 20, 25, or 50 or more tubulars can be included in the tube bundle 150. The number and length of the tubulars 149 can be based on the amount of heat transfer duty desired.

The tubulars 149 can be spaced apart from one another to reduce or prevent bridging of particulates therebetween. For example, the spacing between the tubulars 149 can range from a low of about 50 mm, about 70 mm, or about 100 mm to a high of about 120 mm, about 140 mm, or about 160 mm or more apart to reduce or prevent bridging of particulates therebetween. The distance between the tubulars 149 can be based, at least in part, on the particular size of the particulates that can be or are expected to be conveyed through the heat exchanger 100.

The tubulars 149 can have any desired shape. For example, at least a portion of the tubulars 149 can be in the form of a cube, a rectangular box, a cylinder, a triangular prism, a hyperboloid structure, or some other shape or combination thereof. The tubulars 149 can be cylindrical. The tubulars 149 can be oriented vertically or substantially vertically. For example, substantially vertical tubulars 149 can be at an angle of about −20 degrees to about 20 degrees, about −15 degrees to about 15 degrees, about −10 degrees to about 10 degrees, about −5 degrees to about 5 degrees, about −3 degrees to about 3 degrees, about −2 degrees to about 2 degrees, about −1 degree to about 1 degree, about −0.1 degree to about 0.1 degree, about −0.01 degree to about 0.01 degree, about −0.001 degree to about 0.001 degree, or about −0.0001 degree to about 0.0001 degree with respect to a vertical.

The tubulars 149 can each contain or include an inner conduit 155 at least partially disposed therein. Each inner conduit 155 can be connected to or integral with the inlet manifold 125. The placement of each inner conduit 155 within each tubular can form or otherwise provide an annular space or region between each tubular 149 and each inner conduit 155. An inner conduit 155 can be concentrically disposed within each tubular 149, creating an annular space between the inner conduit 155 and the tubular 149. The combination of a tubular 149 and the inner conduit 155 at least partially disposed therein can form or provide what is commonly referred to as a bayonet type or bayonet style tube.

The plurality of inner conduits 155 can be supported by one or more support members or one or more second tube sheets 167. The second tube sheet 167 can be positioned at any point near the top ends 159 of the plurality of inner conduits 155. At least a portion of the top ends 159 of the plurality of inner conduits 155 can be positioned above the second tube sheet 167. The second tube sheet 167 can be connected to or integral with the outer surface of the inner conduits 155. The second tube sheet 167 can be connected to the inner conduit 155 in any manner sufficient to support at least the entire weight of the combined inner conduits 155. The inner conduits 155 can be free hanging within the tubulars 149 and entirely supported by the second tube sheet 167. The second tube sheet 167 can be sealably secured to the inner surface 112 of the sidewall 111 of the housing 110. The second tube sheet 167 can create a fluid tight seal with the inlet manifold 125 and the outlet manifold 135 thus forming part of the outlet manifold 135 and the inlet manifold 125.

The housing 110 and any of one or more parts or components therein can be made from suitable metals, metal alloys, composite materials, polymeric materials, or the like. For example, the housing 110, including the inlet 120 and outlet 130, can be composed of carbon steel or low chrome steel, and the internals, i.e., the tubulars 149, the stabilizers 175, the inner conduits 155, the manifolds 125, 135, the tube sheet 165, and the inlet and outlet pipes 123, 133, can be composed of stainless steel.

In operation, the heat exchanger 100 can receive particulates, e.g., ash, through the particulate inlet 105. A coolant, e.g., water, can be introduced through the inlet 120 prior to the particulates entering the housing 110 or simultaneously. Although not shown, an external vessel can supply coolant to the inlet 120 and/or receive coolant from the outlet 130 via external piping, where the external piping can be in fluid communication with the inlet 120 and/or the outlet 130. The coolant can pass from the inlet 120, through the inlet tube 123, to the inlet manifold 125 via gravity. In another example, the coolant introduced via inlet tube 123 to the inlet manifold 125 can be pressurized. The inlet manifold 125 can distribute the coolant to the inner conduits 155 disposed within the tubulars 149. The coolant can travel down the inner conduits 155 and exit the inner conduits 155 at the distal ends 157 of the inner conduits 155 near the enclosed distal ends 160 of the tubulars 149 via gravity (see arrows indicating flow path). The coolant can reverse direction and travel through the annular space between the inner conduits 155 and the tubulars 149 and enter the outlet manifold 135 upon leaving the tubulars 149 (see arrows). The coolant can exit the outlet manifold 135 via the outlet pipe 133 (see arrows). In an example, as the coolant exits the inner conduits 155, it can warm and can at least partially vaporize, resulting in the coolant having a lower density. The lower density of the warmed coolant allows the warmed coolant to rise along the annulus (see arrows) and exit into the outer manifold 135. In another example, the dense cool coolant can flow down the inner conduits 155 via gravity alone.

The particulate inlet 105 can be disposed closer to the closed distal ends 160 than to the open ends 162 proximal the tube bundle 150. For example, the particulate inlet 105 can be disposed at least about 1 cm, about 5 cm, about 15 cm, about 30 cm, at least about 100 cm, at least about 150 cm, at least about 300 cm, at least about 450 cm, at least about 600 cm, at least about 750 cm, at least about 900 cm, at least about 2000 cm, at least about 5000 cm, or at least about 10,000 cm above the lowermost end or closed distal end of the tubulars 149. As such, the particulates entering the housing 110 from the particulate inlet 105 can form a dense phase of particulates that can pass between the tubulars 149. A dilute phase of particulates can be present above the dense phase of particulates. As the particulates flow through the heat exchanger 100, heat can be indirectly transferred to the coolant to produce cooled particulates and heated coolant. The heated coolant can be recovered from the outlet 130 of the heat exchanger 100 and fed to another part of a system or process, e.g., steam drums and/or economizers. Cooled particulates from the bottom of the dense phase can exit the heat exchanger 100 via the cool particulate outlet 115.

The coolant can be introduced to the inlet 120 at any desired pressure. For example, the coolant can enter the inlet 120 at a pressure matching the pressure in the heat exchanger 100. This can help maintain the coolant at a desired velocity and/or reduce boiling of the coolant flowing through the tubulars 149, the inlet and outlet manifolds 125, 135, and/or the inlet and outlet tubes 123, 133. For example, a sufficient amount of coolant can flow into the inlet 120 such that the coolant does not completely vaporize within the annuli of the tubulars 149. In another example, less than about 90 vol %, less than about 70 vol %, less than about 50 vol %, less than about 30 vol %, less than about 20 vol %, less than about 10 vol %, less than about 5 vol %, less than about 2 vol %, or less than about 1 vol % of the coolant flowing into the inlet 120 can be vaporized. In an even further example, a low of about 1 vol %, about 2 vol %, about 5 vol % to a high of about 10 vol %, about 20 vol %, about 30 vol % of the coolant flowing into the inlet 120 can be vaporized.

The coolant can enter the inlet 120 at a pressure ranging from a low of about 101 kPa, about 150 kPa, about 350 kPa, or about 700 kPa to a high of about 3,500 kPa, about 6,900 kPa, about 13,800 kPa, or about 20,000 kPa. The coolant can enter the inlet 120 at a temperature ranging from a low of about 15° C., about 30° C., about 60° C., about 90° C. to a high of about 175° C., about 250° C., about 300° C., or about 350° C. In another example, the coolant can enter the inlet 120 at a temperature of from about 38° C. to about 335° C., about 45° C. to about 275° C., or about 75° C. to about 200° C. Although pressure ranges and temperature ranges are indicated, the pressure and temperature of the cooling can vary widely depending, at least in part, on the pressure and temperature of particulates traveling through heat exchanger 100. The coolant recovered from the outlet 130 can have an increased temperature compared to the temperature of the coolant entering through the inlet 120. For example, the coolant recovered from the outlet 130 can have a temperature ranging from a low about 0.5° C., about 1° C., about 5° C., or about 10° C. to a high of about 50° C., about 100° C., about 150° C., or about 200° C. more than the temperature of the coolant entering through the inlet 120.

Illustrative particulates can include, but are not limited to, ash particles, sand, ceramic particles, catalyst particles, fly ash, slag, or any combination thereof. As such, the particulates can be produced, used in, or otherwise recovered from any number of hydrocarbon processes. For example, the particulates can be produced, used in, or otherwise recovered from a gasification process, a catalytic cracking process such as a fluidized catalytic cracker or the like. Suitable gasification processes can include one or more gasifiers. The one or more gasifiers can be or include any type of gasifier, for example, a fixed bed gasifier, an entrained flow gasifier, and a fluidized bed gasifier. In at least one example, the gasifier can be a fluidized bed gasifier.

As used herein, the term "coarse," e.g., coarse ash and coarse ash particulates, refers to particulates having an average particle size ranging from a low of about 35 μm, about 45 μm, about 50 μm, about 75 μm or about 100 μm to a high of about 500 μm, about 750 μm, about 1,000 μm, or about 5,000 μm. For example, coarse ash particulates can have an average particle size of from about 50 μm to about 1,000 μm, about 100 μm to about 750 μm, about 125 μm to about 500 μm, or about 150 μm to about 250 μm. As used herein, the term "fine," e.g., fine ash and fine ash particulates, refer to particulates having an average particle size ranging from a low of about 2 μm, about 5 μm, or about 10 μm to a high of about 75 μm, about 85 μm, or about 95 μm. For example, fine ash particulates can have an average particle size of from about 5 μm to about 30 μm, about 7 μm to about 25 μm, or about 10 μm to about 20 μm.

Figure 2:
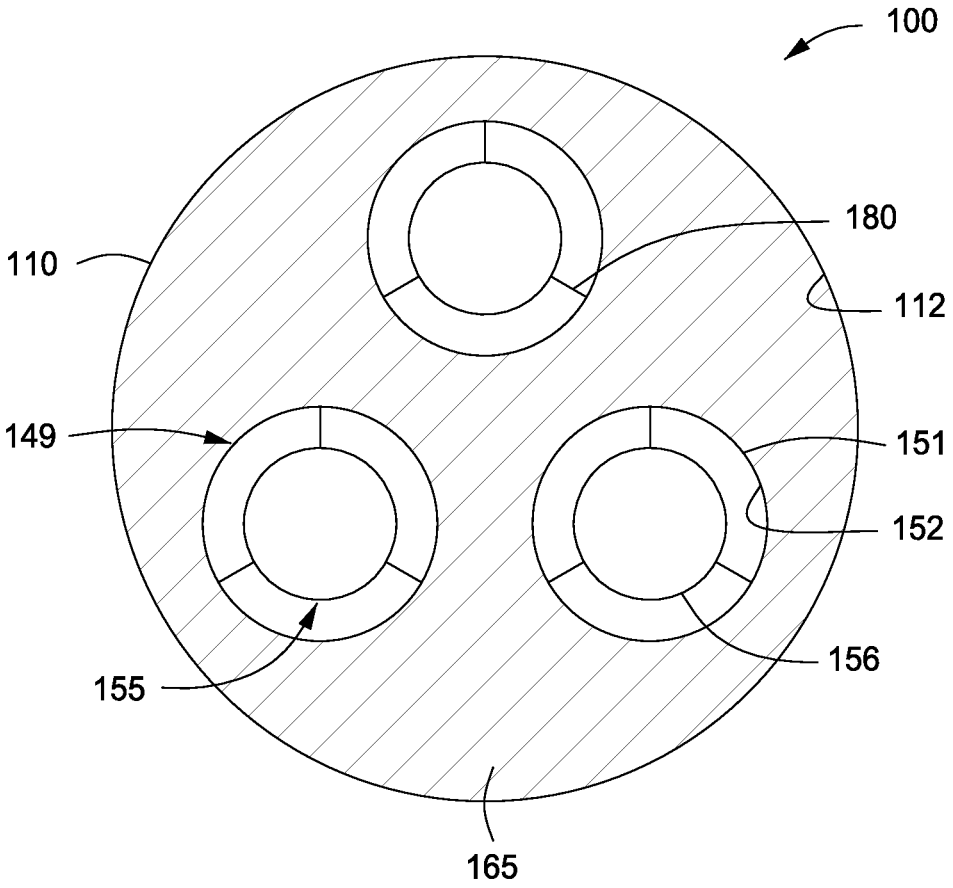
FIG. 2 depicts a cross-sectional view of the heat exchanger depicted in FIG. 1 along line 2-2.

FIG. 2 depicts a cross-sectional view of the heat exchanger 100 depicted in FIG. 1 along line 2-2. The housing 110 of the heat exchanger 100 can have a polygonal shape including, but not limited to, circular, a rectangular shape, a triangular shape, a square shape, a pentagonal shape, a hexagonal shape, star shape, etc., or any combination thereof. For example, the housing 110 can have a circular cross-section, as shown. The housing 110 can have the same shape or a different shape from the bottom end 101 and the top end 102. For example, a middle portion of the housing 110 can have a circular cross-section and the top and bottom ends 102, 101 can have a square cross-section.

The tube sheets 165, 167 can have a variety of shapes and sizes. For example, when the housing 110 is cylindrical, as shown, the first tube sheet 165 has a size and shape corresponding to the size and shape of the housing 110. The first tube sheet 165 can be disposed on or otherwise secured to the inner surface 112 of the sidewall 111. The first tube sheet 165 can be disposed and/or secured directly to the inner surface 112 of the sidewall 111. For example, the first tube sheet 165 can be secured to the inner surface 112 of the sidewall 111 directly by a fastener (e.g., a weld, rivet, and/or bolt). In another example, the first tube sheet 165 can be sealably secured to the inner surface 112 of the sidewall 111 by a weld or other substrate or mechanism sufficient to fluidly isolate the outlet manifold 135 and the interior of the housing 110. In a further example, the first tube sheet 165 can be sealably secured to the inner surface 112 of the sidewall 111 such that the outlet manifold 135 can be fluidly isolated from the interior of the housing 110. In addition, the second tube sheet 167 (not shown in FIG. 2) can be sealably secured to the inner surface 112 of the sidewall 111 such that both the outlet manifold 135 and the inlet manifold 125 are fluidly isolated from each other.

The first tube sheet 165 can contain or secure the tube bundle 150. The first tube sheet 165 can be disposed on or otherwise secured to the outer surfaces 151 of each tubular 149. The first tube sheet 165 can be disposed and/or secured directly to the outer surfaces 151 of each tubular 149. For example, the first tube sheet 165 can be secured to the outer surfaces 151 of each tubular 149 directly by a fastener (e.g., a weld or bolt). In another example, the first tube sheet 165 can be sealably secured to the outer surfaces 151 of each tubular 149 by a weld or other substrate or mechanism sufficient to fluidly isolate the outlet manifold 135 and the interior of the housing 110. The tubulars 149 are shown each having an inner conduit 155. The inner conduit 155 can be positioned within the tubular 149. For example, the tubulars 149 can be concentrically disposed or positioned within the tubular 149. Inner conduit stabilizers 180 can be placed in the annulus between the outer wall 156 of the inner conduit 155 and the inner surface 152 of the tubulars 149 to reduce or prevent vibration and to maintain the inner conduit 155 in a concentric position within the tubulars 149. In an example, the first tube sheet 165 can be sealably secured to the outer surfaces 151 of each tubular 149 and the second tube sheet 167 (not shown in FIG. 2) can be sealably secured to the outer surfaces 156 of each inner conduit 155 such that both the outlet manifold 135 and the inlet manifold 125 are fluidly isolated from each other and from the interior of the housing 110.

For a cylindrical housing 110, the tubulars 149 can be arranged in one or more rows or in at least one cylinder or ring formation (not shown). For example, the tubulars 149 can be arranged in multiple rows or in concentric cylinders or rings. The tubulars 149 can be arranged in concentric cylinders or rings and each cylinder or ring can contain a distinct size and number of tubulars 149. For example, a first ring of tubulars 149 can have a first diameter of from about 25 cm to about 35 cm and of from about 4 to about 10 tubulars 149. A second ring of tubulars 149 can have a second diameter of from about 40 cm to about 50 cm and of from about 14 to about 24 tubulars 149. A third ring of tubulars 149 can have third diameter of from about 55 cm to about 65 cm and can have of from about 20 to about 26 tubulars 149. A fourth ring of tubulars 149 can have a fourth diameter of from about 70 cm to about 80 cm and of from about 27 to about 33 tubulars 149. A fifth ring of tubulars 149 can have fifth diameter of from about 85 cm to about 95 cm and can have of from about 32 to about 40 tubulars 149. A sixth ring of tubulars 149 can have sixth diameter of from about 100 cm to about 110 cm and can have of from about 38 to about 48 tubulars 149.

Figure 3:
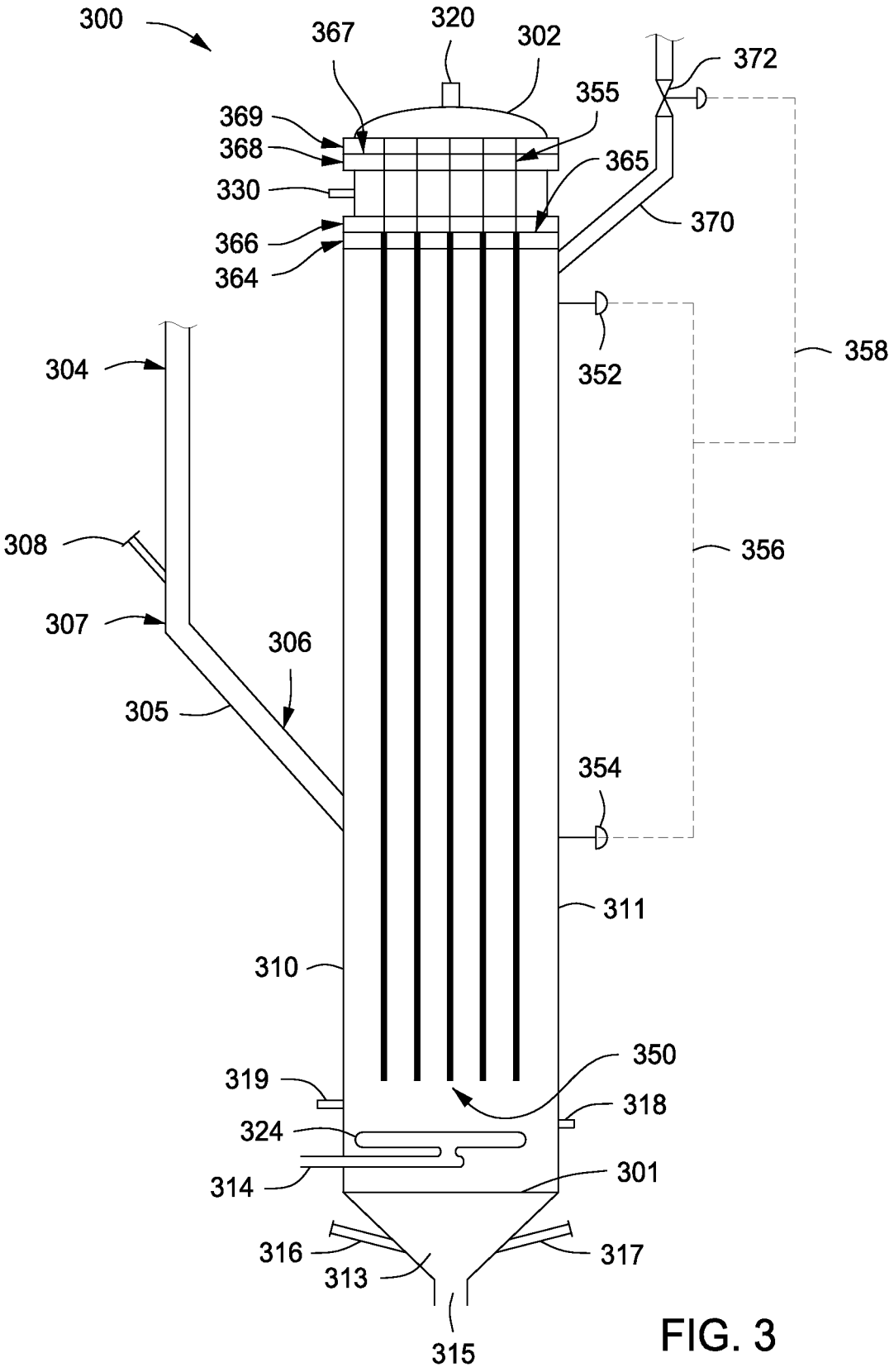
FIG. 3 depicts a cross-sectional side view of an illustrative heat exchange system, according to one or more embodiments described.

FIG. 3 depicts a cross-sectional side view of an illustrative heat exchange system 300, according to one or more embodiments. The heat exchange system 300 can include one or more particulate inlets 305, one or more particulate outlets 315, and one or more narrowing member 313. The heat exchange system 300 can also include one or more inlet manifolds (not shown), one or more outlet manifolds (not shown), and one or more heat exchange members or tubulars 350. The heat exchange system 300 can also include a housing 310 having one or more sidewalls (one is shown 311), a top end 302, and a bottom end 301. The housing 310 can have a plurality of shapes including, but not limited to, a cube, a rectangular box, a cylinder, a triangular prism, a hyperboloid structure, or some other shape or combination thereof*. As shown, the housing 310 can be cylindrical. The housing 310 can have a size and shape sufficient to house a tube bundle 350.

The inlet manifold can be at least partially disposed within the housing 310 and can be in fluid communication with the coolant inlet 320. For example, the inlet manifold can be joined to or in fluid communication with the inlet 320 via an inlet tube or inlet pipe (not shown). The outlet manifold can also be at least partially disposed within the housing 310 and can be in fluid communication with the outlet 330. For example, the outlet manifold can be joined to the outlet via an outlet tube or outlet pipe (not shown). The inlet manifold and the outlet manifold can be disposed above the one or more heat exchange members or tubulars 350.

The tube bundle 350 can be supported by one or more support members or one or more first tube sheets 365. The first tube sheet 365 can disposed between flanges 364 and 366. The first tube sheet 365 can be fastened to the housing 310 via the flanges 364 and 366. The flanges 364 and 366 can fasten the first tube sheet 365 such that when the tubulars 350 are disposed in the first tube sheet 365 a seal can be created fluidly isolating the space above the first tube sheet 365 and the space below the first tube sheet 365. The first tube sheet 365 can be connected to the tubulars 350 in any manner sufficient to support at least the entire weight of the combined tubulars 350.

The plurality of inner conduits 355 can be supported by one or more support members or one or more second tube sheets 367. The second tube sheet 367 can disposed between flanges 368 and 369. The second tube sheet 367 can be fastened to the housing 310 via the flanges 368 and 369. The flanges 368 and 369 can fasten the second tube sheet 367 such that when the inner conduits 355 are disposed in the second tube sheet 367 a seal can be created fluidly isolating the space above the second tube sheet and the space below the second tube sheet. The second tube sheet 367 can be connected to the inner conduits 355 in any manner sufficient to support at least the entire weight of the combined inner conduits 355.

The one or more particulate inlets 305 can be located at any point along the one or more sidewalls 311 of the heat exchange system 300. For example, the one or more particulate inlets 305 can be located at a height on the housing 310 closer to the bottom end 301 than the top end 302. For example, the one or more particulate inlets 305 can be situated at a height closer to the closed distal ends 360 of the tubulars 350 than to the first tube sheet 365. The particulate inlet 305 can have an upper end 304 and a lower end 306. The particulate inlet 305 can contain an elbow 307 disposed between the upper end 304 and the lower end 306.

The particulate inlet 305 can also contain an aeration nozzle 308. The aeration nozzle 308 can be positioned at any location along the particulate inlet 305 sufficient to aid the distribution of hot particulates down the particulate inlet 305 and into the housing 310. As depicted, the aeration nozzle 308 can be disposed between the upper end 304 and the elbow 307. Although not included in the drawings, the aeration nozzle 308 can be positioned at any location along the lower end 306 between the elbow 307 and the one or more sidewalls 311. The aeration nozzle 308 can be disposed at any angle such that the aeration nozzle can direct air, particulates and/or fluid toward the tube bundle 350. For example, the aeration nozzle 308 can be disposed at an angle from a low of about 30°, about 40°, or 50° to a high of about 70°, about 80°, or about 90° with respect to the axial direction. In another example, the aeration nozzle 308 can be disposed at an angle of from about 35° to about 85° or from about 45° to about 75° from the axial direction. In yet another example, the aeration nozzle 308 can be disposed at an angle of about 55°, about 60°, or about 65° from the axial direction.

Sacrificial bars (not shown) can be included near the particulate inlet 305 in order to shield the tube bundle 350 from fresh hot particulates entering the housing 310 via the particulate inlet 305. The sacrificial bars can be composed of carbon steel, low chrome steel, stainless steel, or any other material sufficient to withstand direct contact with hot particulates exiting the particulate inlet 305. The sacrificial bars can shield at least part of the tubulars 350 from direct contact from the hot particulates immediately exiting the particulate inlet 305. The sacrificial bars can completely shield all of the tubulars 350 from any direct contact from hot particulates immediately exiting the particulate inlet 305. The sacrificial bars can also be placed in lieu of tubulars 350 at the location(s) closest to the particulate inlet 305.

The hot particulates entering the housing 310 via the hot particulate inlet 305 can form a dense phase bed of fluidized particulates and a dilute phase bed of fluidized particulates situated above the dense phase bed. The hot particulate inlet 305 can enter the housing at or below the dense phase surface. The dense phase can occupy up to about 10%, up to about 20%, up to about 30%, up to about 40%, up to about 50%, up to about 60%, up to about 70% of the interior height of the housing 310. The dilute phase can occupy up to about 30%, up to about 40%, up to about 50%, up to about 60%, up to about 70%, up to about 80%, up to about 90% of the interior height of the housing 310.

At least one aeration nozzle 314 can be disposed through the sidewall 311 near the bottom end 301 of the housing 310. The aeration nozzle 314 can be disposed at a distance beneath the tubulars 350 sufficient to reduce or prevent erosion of the tubulars 350 from the aeration gas exiting the aeration nozzle 314. For example, the aeration nozzle 314 can be disposed at least about 15 cm, at least about 30 cm, at least about 60 cm, at least about 90 cm, at least about 120 cm, at least about 150 cm, at least about 2 m, or at least about 3 m below the lowermost end or closed distal end of the tubulars 350. The aeration nozzle 314 can be disposed at any angle such that the aeration nozzle can direct air, particulates, and/or fluid toward the tube bundle 350. For example, the aeration nozzle 314 can be disposed at an angle from a low of about 30°, about 40°, or 50° to a high of about 70°, about 80°, or about 90° with respect to the axial direction. In another example, the aeration nozzle 314 can be disposed at an angle of from about 35° to about 85° or from about 45° to about 75° from the axial direction. In yet another example, the aeration nozzle 314 can be disposed at an angle of about 55°, about 60°, or about 65° from the axial direction. The aeration nozzle 314 can have an internal projection 324 inside above the bottom end 301 of the housing 310. The internal projection 324 can be a tube having one or more perforations at an end that can be at least partially disposed inside the housing 310. The aeration nozzle 314 can provide fluff air to get air and/or particulates flowing up toward the tube bundle 350.

The amount of aeration gas exiting the nozzle 314 can determine the size, density, and level of the dense bed of particulates. Aeration gas leaving the aeration nozzle 314 can first flow through the dense bed, second through the dilute bed from bottom to top, and third exit the housing 310 via line 370 located at the top of the housing 310. In one or more embodiments, the flow of aeration gas can be only in one direction, upward from the aeration nozzle 314 disposed beneath the tubulars 350 through the dense bed followed by the dilute bed and finally out of the housing 310 via line 370. In one or more embodiments, the flow of hot particulates can be only in one direction, from the hot particulate inlet 305 to the housing 310 and from the housing 310 to the cooled particle outlet 315. The amount of aeration gas exiting the nozzle 314 can in part be determined by the amount of aeration gas leaving the housing 310 via line 370. Line 370 can include a valve 372, which when closed can reduce or prevent aeration gas from leaving the housing 310. In addition, since the amount of aeration gas can be released from system 300 via line 370, the amount of aeration gas exiting the nozzle 314 can help determine the level of the dense bed of particulates.

A pressure differential between the dense phase and the dilute phase can be monitored via pressure sensors 352 and 354. As depicted, pressure sensor 352 can be located in the dilute bed near the top of the housing 310 and the vent gas line 370. Pressure sensor 354 can be located in the dense bed near the particulate inlet 350. Pressure data observed via the pressure sensors 352, 354 can be transmitted via lines 356 and 358 used to control a control valve 372. The control valve 372 can be opened and closed based on the observed pressure differential in order to maintain a desired pressure differential in the housing 310 and thus maintain a desired height of the dense bed within the housing 310.

A narrowing member 313 can be disposed at the bottom end 301 of the housing 310. The narrowing member 313 can be frustoconical or a cone, for example. The narrowing member 313 can have a particulate outlet 315 disposed on narrowest end of the narrowing member 313 for the removal of cooled particulates from the heat exchange system 300.

The narrowing member 313 can include one or more aeration nozzles (two are shown 316, 317) disposed in a sidewall thereof. The aeration nozzles 316, 317 can be disposed at any angle with respect to the housing and/or the axial direction such that aeration nozzles 317 can direct a second aeration fluid toward the particulate outlet 315. For example, air, nitrogen, carbon dioxide, argon, or any combination thereof can be introduced as a second aeration fluid via nozzles 316, 317. The second aeration fluid can be an inert gas such as nitrogen. The second aeration fluid can also be or include air.

The aeration nozzles 316, 317 can be disposed at an angle from a low of about 30°, about 40°, or 50° to a high of about 70°, about 80°, or about 90° with respect to the axial direction. In another example, the aeration nozzles 316, 317 can be disposed at an angle of from about 35° to about 85° or from about 45° to about 75° from the axial direction. In yet another example, the aeration nozzles 316, 317 can be disposed at an angle of about 55°, about 60°, or about 65° from the axial direction.

Although not shown, the aeration nozzles 316, 317 can have an internal projection inside the narrowing member 313 of the housing 310. The internal projection can be a tube having one or more perforations at an end that can be at least partially disposed inside the narrowing member 313 of the housing 310. The aeration nozzles 316, 317 can provide fluff air to get air and/or cooled particulates flowing out through the particulate outlet 315.

The housing 310 can have one or more pressure sensor openings 318 and/or one or more temperature sensor openings 319 disposed in or on the housing 310 at a position below the tubulars 350. One or more pressure sensors (not shown) can be at least partially disposed in the pressure sensor opening 318, and one or more temperature sensors (not shown) can be at least partially disposed in the temperature sensor opening 319. The pressure sensor opening 318 and the temperature sensor opening 319 can have the same or different angle with respect to an axial direction of the housing 310. For example, the pressure sensor opening 318 and/or the temperature sensor opening 319 can be disposed at an angle from a low of about 30°, about 40°, or about 50° to a high of about 70°, about 80°, or about 90° with respect to the axial direction of the housing 310. In another example, the pressure sensor opening 318 and the temperature sensor opening 319 can be disposed at an angle of from about 35° to about 85° or from about 45° to about 75° from the axial direction of the housing 310. In yet another example, the pressure sensor opening 318 and the temperature sensor opening 319 can be disposed at an angle of about 55°, about 60°, or about 65° from the axial direction of the housing 310. In yet another example, the pressure sensor opening 318 can be disposed at a 45° with respect to the axial direction of the housing 310 and the temperature sensor opening 319 can be disposed at a 90° with respect to the axial direction of the housing 310.

Particulates, e.g., ash, coming into the heat exchange system 300 can have a temperature ranging from a low of about 400° C., about 500° C., about 550° C., about 600° C., about 650° C., about 700° C., about 750° C., or about 800° C. to a high of about 900° C., about 950° C., about 1,000° C., about 1,050° C., about 1,100° C., about 1,150° C., about 1,200° C., about 1,250° C., about 1,350° C., or about 1,400° C. For example, the particulates coming into the heat exchange system 300 can have a temperature of from about 785° C. to about 1,250° C., about 900° C. to about 1,150° C., about 925° C. to about 1,125° C., or about 950° C. to about 1,100° C. In another example, particulates coming into the heat exchange system 300 can have a temperature of about 975° C. to about 1,050° C. The particulates coming into the heat exchange system 300 can be at the same pressure as that of the system, e.g., a gasification system, and can vary from system to system. For example, the particulates can enter into the heat exchange system 300 at a pressure ranging from a low about 101 kPa, about 500 kPa, about 1,000 kPa, or about 1,500 kPa to a high of about 3,500 kPa, about 4,000 kPa, about 4,500, or about 5,000 kPa. In another example, the particulates can enter the heat exchange system 300 at a pressure of from about 250 kPa to about 4,750 kPa, about 750 kPa to about 4,250 kPa, or about 1,250 kPa to about 3,750 kPa.

Particulates coming out of the heat exchange system 300 can have a temperature ranging from a low of about 100° C., about 110° C., about 120° C., about 130° C., about 140° C., about 150° C., about 160° C., or about 165° C. to a high of about 170° C., about 175° C., about 180° C., about 185° C., about 190° C., about 200° C., about 210° C., about 220° C., about 230° C., or about 240° C. For example, the particulates coming out the heat exchange system 300 can have a temperature of from about 145° C. to about 205° C., about 155° C. to about 195° C., or about 165° C. to about 185° C. In another example, particulates coming out the heat exchange system 300 can have a temperature of about 175° C., about 176° C., or about 177° C.

The particulates can have a residence time in the heat exchange system 300 ranging from a low of about 1 s, about 5 s, about 10 s, about 40 s, or about 80 s to a high of about 600 s, about 900 s, about 1800 s, about 2500 s, or about 5000 s. For example, the particulates can have a residence time within the heat exchange system 300 ranging from about 15 seconds to about 1150 seconds, about 45 seconds to about 850 seconds, or about 85 seconds to about 550 seconds. The particulates can be introduced to the heat exchange system 300 at a rate ranging from a low of about 0.01 kg/m$^2$-s, about 40 kg/m$^2$-s, or about 80 kg/m$^2$-s to a high of about 600 kg/m$^2$-s, about 800 kg/m$^2$-s, or about 1000 kg/m$^2$-s. For example, the particulates can be introduced via inlet 304 to the heat exchange system 300 at a rate of about 0.01 kg/m$^2$-s to about 950 kg/m$^2$-s, about 45 kg/m$^2$-s to about 750 kg/m$^2$-s, or about 85 kg/m$^2$-s to about 550 kg/m$^2$-s.

Figure 4:
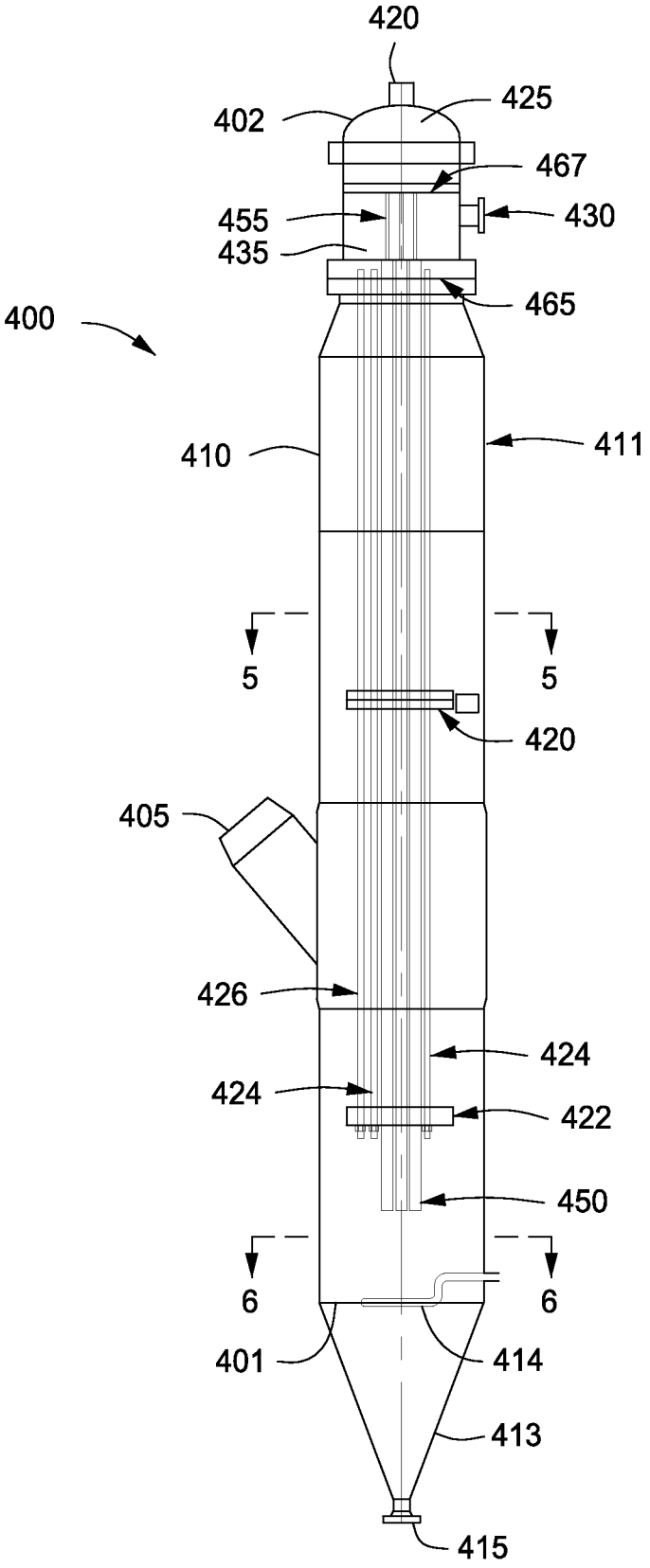
FIG. 4 depicts a cross-sectional side view of an illustrative heat exchange system having support members, according to one or more embodiments described.

FIG. 4 depicts a transparent side view of an illustrative heat exchange system 400, according to one or more embodiments. The heat exchange system 400 can include one or more particulate inlets 405, one or more particulate outlets 415, and a narrowing member 413. The heat exchange system 400 can also include one or more inlet manifolds 420, one or more outlet manifolds 430, and one or more heat exchange members or tubulars 450. The heat exchange system 400 can also include a housing 410 having one or more sidewalls (one is shown 411), a top end 402, and a bottom end 401. The housing 410 can have a plurality of shapes, including, but not limited to, a cube, a rectangular box, a cylinder, a triangular prism, a hyperboloid structure, or some other shape or combination thereof. As shown, the housing 410 can be cylindrical. The housing 410 can have a size and shape sufficient to house a tube bundle 450. The narrowing member 413 can be disposed at the bottom end 401 of the housing 410. The narrowing member 413 can be frustoconical or a cone, for example. The particulate outlet 415 can be disposed on the narrowest end of the narrowing member 413 for the removal of cooled particulates from the heat exchange system 400. An aeration nozzle 414 can be disposed near the bottom end 401 of the housing 410.

The tube bundle 450 can be supported by one or more support members or one or more first tube sheets 465. The first tube sheet 465 can be secured such that when the tubulars 450 are disposed in the first tube sheet 465 a seal can be created fluidly isolating the space above the first tube sheet 465 and the space below the first tube sheet 465. The first tube sheet 465 can be connected to the tubulars 450 in any manner sufficient to support at least the entire weight of the combined tubulars 450. One or more guide members 424 and one or more sacrificial bars 426 can also be entirely supported by the one or more first tube sheets 465. The first tube sheet 465 can support the combined weight of the tube bundle 450, the guide members 424, the sacrificial bars 426, and the grid guides 420, 422.

The plurality of inner conduits 455 can be supported by one or more support members or one or more second tube sheets 467. The second tube sheet 467 can be secured such that when the inner conduits 455 are disposed in the second tube sheet 467 a seal can be created fluidly isolating the space above the second tube sheet and the space below the second tube sheet. The second tube sheet 467 can be connected to the inner conduits 455 in any manner sufficient to support at least the entire weight of the combined inner conduits 455.

The guide members 424 can extend the length of the housing 410 disposed alongside the tube bundle 450. The guide members 424 can be used to support the grid guides 420, 422. For example, the one or more guide members 424 can support an upper grid guide 420 and a lower grid guide 422. The location and placement of the one or more grid guides can aid in the alignment of the tube bundle 450 and reduce any vibration of the tube bundle 450. The guide members 424 can be axially oriented with respect to a longitudinal axis of the housing 110 and/or can be substantially straight. The substantially straight length of the guide members 424 can be optimized to reduce or avoid vibration and/or to facilitate maintenance of the tubulars 450. The guide members 424, upper grid guide 420, and the lower grid guide 422 can be made from suitable metals, metal alloys, composite materials, polymeric materials, or the like. For example, the guide members 424, upper grid guide 420, and the lower grid guide 422 can be composed of stainless steel.

Sacrificial bars 426 can be included near the particulate inlet 405 in order to shield the tube bundle 450 from fresh hot particulates entering the housing 410 via the particulate inlet 405. The sacrificial bars can be composed of carbon steel, low chrome steel, stainless steel, or any other material sufficient to withstand direct contact with hot particulates exiting the particulate inlet 405. The sacrificial bars 426 can shield at least part of the tubulars 450 from direct contact from the hot particulates immediately exiting the particulate inlet 405. The sacrificial bars 426 can at least partially or completely shield all of the tubulars 450 from any direct contact from hot particulates immediately exiting the particulate inlet 405. The sacrificial bars can also be placed in lieu of tubulars 450 at the location(s) closest to the particulate inlet 405.

Figure 5:
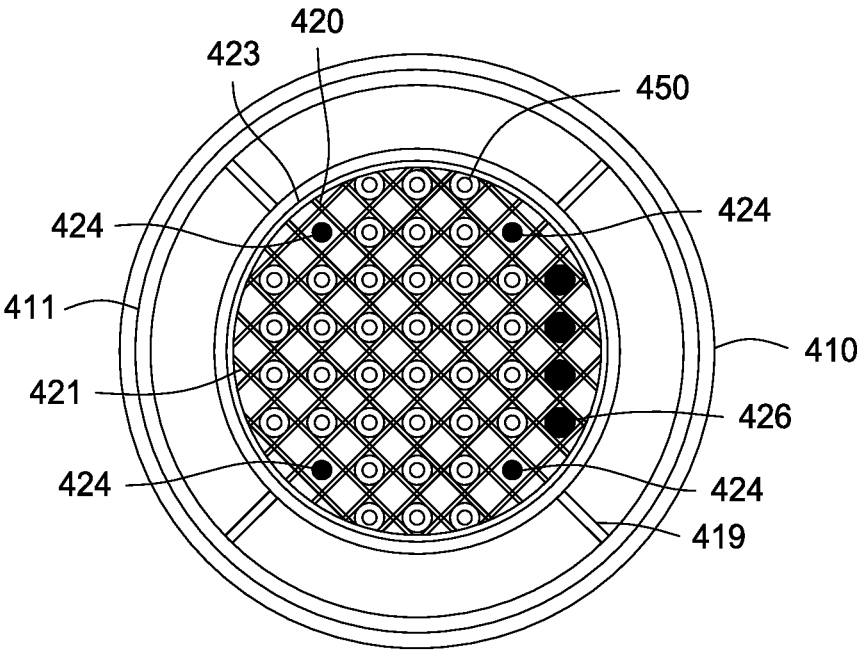
FIG. 5 depicts a cross-sectional view of the heat exchanger depicted in FIG. 4 along line 5-5.

FIG. 5 depicts a cross-sectional view of the heat exchanger depicted in FIG. 4 along line 5-5. The tube bundle 450 is depicted within the housing 410. As depicted, the tube bundle 450 can be positioned alongside four guide members 424 and four sacrificial bars 426. The tube bundle 450, the guide members 424 and the sacrificial bars 426 can be all contained within a guide grid 420. The guide grid 420 is shown having perpendicularly arranged bars 421 forming the guide grid 420. The guide grid 420 can contain a banding bar 423 connected to outer edges of the arranged bars 421 and forming a circumference around the arranged bars 421. The banding bar 423 can secure and maintain the arranged bars 421 in a grid pattern. The four guide members 424 are shown evenly distributed near the circumference of the banding bar 423. The guide grid 420 can be further secured in the housing 410 via securing members 419 positioned equidistantly along the outer circumference of the banding bar 423. The securing members 419 can contact, attach, join, couple, or otherwise connect to the inner surface of the one or more sidewalls 411 of the housing 410.

Figure 6:
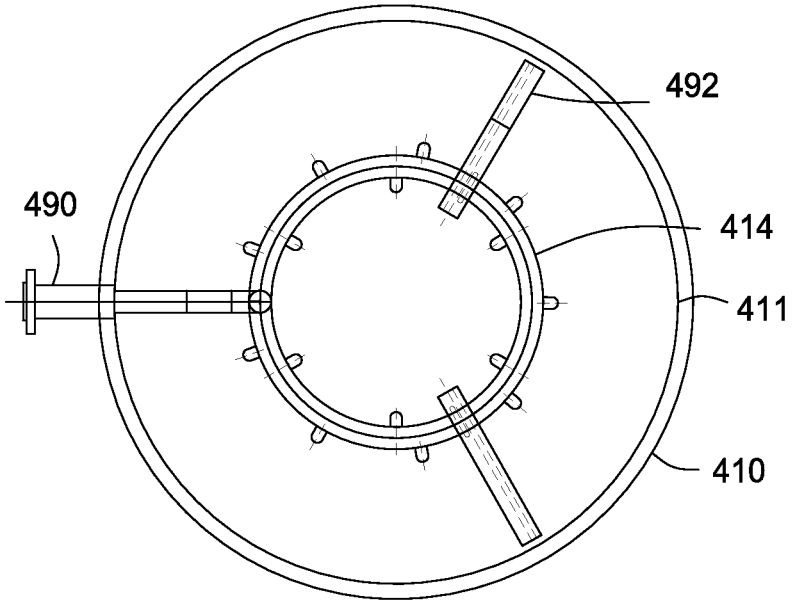
FIG. 6 depicts a cross-sectional view of the heat exchanger depicted in FIG. 4 along line 6-6.

FIG. 6 depicts a cross-sectional view of the heat exchanger depicted in FIG. 4 along line 6-6. The aeration nozzle 414 is shown positioned in the center of the housing 410. Air or other gases can be supplied to the aeration nozzle 414 via an aeration tap 490. The aeration nozzle 414 can be secured and centralized in the housing 410 via aeration centralizers 492 projecting from the aeration nozzle 414. The aeration centralizers 492 can contact, attach, or connect to the inner surface of the one or more sidewalls 411 of the housing 410.

Figure 7:
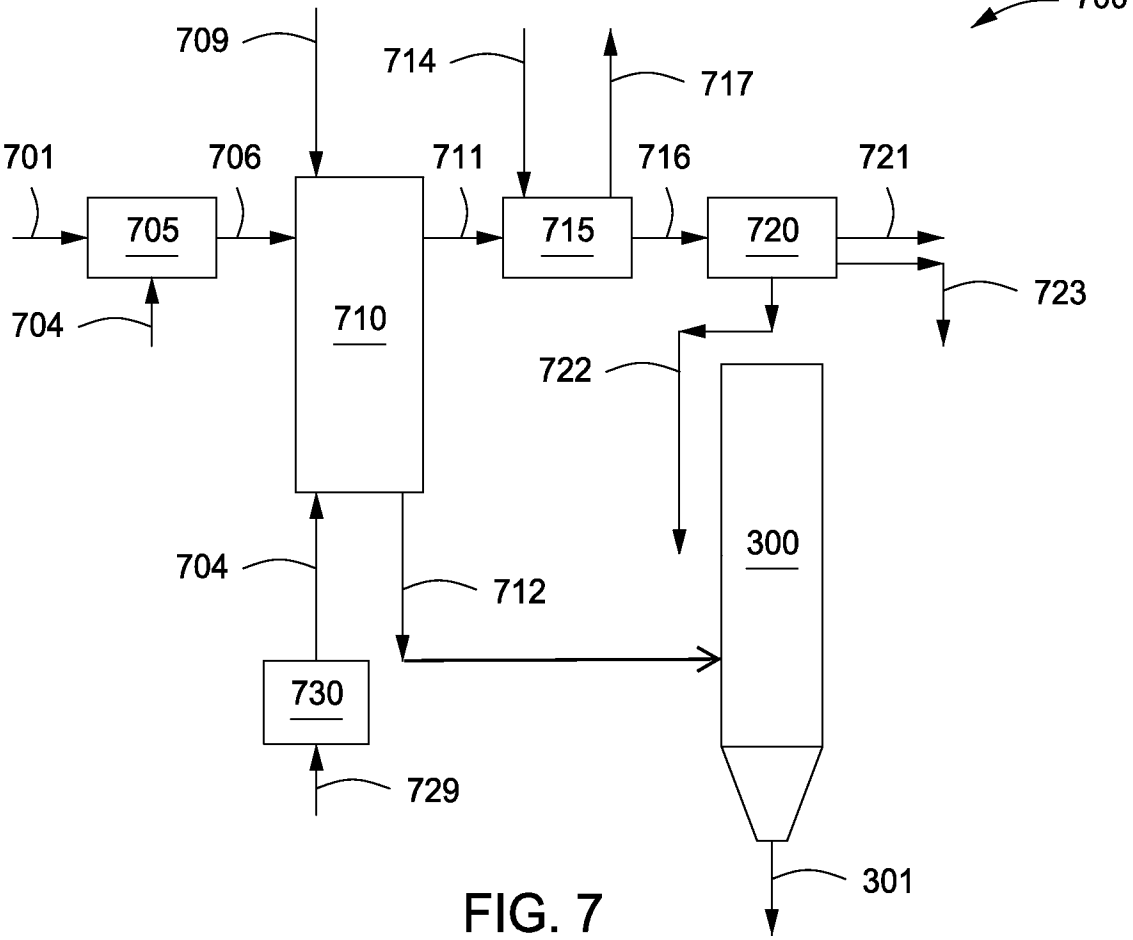
FIG. 7 depicts a schematic view of an illustrative gasification system incorporating the heat exchange system depicted in FIG. 4, according to one or more embodiments described.

FIG. 7 depicts a schematic of an illustrative gasification system 700 incorporating the heat exchange system 300 depicted in FIG. 3, according to one or more embodiments. The gasification system 700 can include one or more hydrocarbon preparation units 705, gasifiers 710, syngas coolers 715, particulate control devices 720, and heat exchange systems 300. A feedstock via line 701 can be introduced to the hydrocarbon preparation unit 705 to produce a gasifier feed via line 706. The feedstock via line 701 can include one or more carbonaceous material, whether solid, liquid, gas, or a combination thereof. The carbonaceous materials can include but are not limited to, biomass (e.g., plant and/or animal matter or plant and/or animal derived matter); coal (e.g., high-sodium and low-sodium lignite, lignite, sub-bituminous, and/or anthracite); oil shale; coke; tar; asphaltenes; low ash or no ash polymers; hydrocarbon-based polymeric materials; biomass derived material; or by-product derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, other polyolefins, poly-hydrocarbons containing oxygen; heavy hydrocarbon sludge and bottoms products from petroleum refineries and petrochemical plants such as hydrocarbon waxes, blends thereof, derivatives thereof, and any combination thereof.

The feedstock via line 701 can include a mixture or combination of two or more carbonaceous materials. For example, the feedstock via line 701 can include a mixture or combination of two or more low ash or no ash polymers, biomass-derived materials, or by-products derived from manufacturing operations. In another example, the feedstock via line 701 can include one or more carbonaceous materials combined with one or more discarded consumer products, such as carpet and/or plastic automotive parts/components including bumpers and dashboards. Such discarded consumer products can be reduced in size to fit within the gasifier 710. Accordingly, the gasification system 700 can be useful for accommodating mandates for proper disposal of previously manufactured materials.

The hydrocarbon preparation unit 705 can be any preparation unit known in the art, depending on the feedstock via line 701 and the desired syngas product in line 721. For example, the hydrocarbon preparation unit 705 can remove contaminants from the feedstock via line 701 by washing away dirt or other undesired portions. The feedstock via line 701 can be a dry feed or can be conveyed to the hydrocarbon preparation unit 705 as a slurry or suspension. The feedstock via line 701 can be dried and then pulverized by one or more milling units (not shown) prior to being introduced to the hydrocarbon preparation unit 705. For example, the feedstock via line 701 can be dried from a high of about 35% moisture to a low of about 18% moisture. A fluid bed drier (not shown) can be used to dry the feedstock via line 701, for example. The feedstock via line 701 can have an average particle diameter size of from about 50 μm, about 150 μm, or about 250 μm to about 400 μm, about 500 μm, or about 600 μm or larger. The gasifier feed via line 706, one or more oxidants via line 731, and/or steam via line 709 can be introduced to the gasifier 710 to produce a raw syngas via line 711 and waste, e.g., coarse ash, via line 712.

The oxidant via line 704 can be supplied by an air separation unit 730 to the gasifier 710. The air separation unit 730 can provide pure oxygen, nearly pure oxygen, essentially oxygen, or oxygen-enriched air to the gasifier 710 via line 731. The air separation unit 730 can provide a nitrogen-lean, oxygen-rich feed to the gasifier 710 via line 731, thereby minimizing the nitrogen concentration in the raw syngas provided via line 711 to the syngas cooler 715. The use of a pure or nearly pure oxygen feed allows the gasifier 711 to produce a syngas that can be essentially nitrogen-free, e.g., containing less than about 0.5 mol % nitrogen/argon. The air separation unit 730 can be a high-pressure, cryogenic type separator. Air can be introduced to the air separation unit 730 via line 729. Although not shown, separated nitrogen from the air separation unit 730 can be introduced to a combustion turbine. The air separation unit 730 can provide from about 10%, about 30%, about 50%, about 70%, about 90%, or about 100% of the total oxidant introduced to the gasifier 710.

Although not shown, one or more sorbents can be added to the gasifier 710. The one or more sorbents can be added to capture contaminants from the raw syngas, such as sodium vapor in the gas phase within the gasifier 710. The one or more sorbents can be added to scavenge oxygen at a rate and level sufficient to delay or prevent the oxygen from reaching a concentration that can result in undesirable side reactions with hydrogen (e.g., water) from the feedstock within the gasifier 710. The one or more sorbents can be mixed or otherwise added to the one or more hydrocarbons. The one or more sorbents can be used to dust or coat the feedstock particulates in the gasifier 710 to reduce the tendency for the particulates to agglomerate. The one or more sorbents can be ground to an average particle size of about 5 μm to about 100 μm, or about 10 μm to about 75 μm. Illustrative sorbents can include but are not limited to, carbon-rich ash, limestone, dolomite, and coke breeze. Residual sulfur released from the feedstock can be captured by native calcium in the feed or by a calcium-based sorbent to form calcium sulfide.

The gasifier 710 can be one or more circulating solid or transport gasifiers, one or more counter-current fixed bed gasifiers, one or more co-current fixed bed gasifiers, one or more fluidized bed reactors, one or more entrained flow gasifiers, any other type of gasifier, or any combination thereof. Circulating solid or transport gasifiers operate by introducing the gasifier feed via line 706 and introducing one or more oxidants to one or more mixing zones (not shown) to provide a as mixture. An exemplary circulating solids gasifier can be as discussed and described in U.S. Pat. No. 7,322,690.

The gasifier 710 can produce a raw syngas via line 711, while waste from the gasifier 710, e.g., ash or coarse ash, can be removed via line 712. The waste or ash removed via line 712 can be larger in size than the fine ash via line 722. The waste or ash via line 712 can be disposed of or can be used in other applications. The separated particulates via line 712 can be introduced to the heat exchange system 300 to produce cooled particulates via line 301. The separated particulates via line 712 can enter the heat exchange system 300 at a temperature ranging from a low of about 400° C., about 500° C., about 550° C., about 600° C., about 650° C., about 700° C., about 750° C., or about 800° C. to a high of about 900° C., about 950° C., about 1,000° C., about 1,050° C., about 1,100° C., about 1,150° C., about 1,200° C., about 1,250° C., about 1,350° C., or about 1,400° C. The cooled particulates leaving the heat exchanger 300 via line 301 can have a temperature ranging from a low of about 100° C., about 110° C., about 120° C., about 130° C., about 140° C., about 150° C., about 160° C., or about 165° C. to a high of about 170° C., about 175° C., about 180° C., about 185° C., about 190° C., about 200° C., about 210° C., about 220° C., about 230° C., or about 240° C. The separated particulates via line 712 and/or the cooled particulates via line 301 can have a particle diameter (or an average cross-sectional size) of about 20 μm or less, about 15 μm or less, about 12 μm or less, or about 9 μm or less. Although not shown, one or more heat exchange systems 300 can be joined to the same gasifier 710 or to multiple gasifiers 710. For example, four heat exchange systems 300 can be linked in parallel to each other and to the gasifier 710. Steam via line 709 can be introduced to the gasifier 710 to support the gasification process. In one or more embodiments, however, the gasifier 710 does not include direct steam introduction via line 709.

The raw syngas via line 711 produced in the gasifier 710 can include carbon monoxide, hydrogen, oxygen, methane, carbon dioxide, hydrocarbons, sulfur, solids, mixtures thereof, derivatives thereof, or combinations thereof. The raw syngas via line 711 can contain 85% or more carbon monoxide and hydrogen with the balance being primarily carbon dioxide and methane. The gasifier 710 can convert at least about 85%, about 90%, about 95%, about 98%, or about 99% of the carbon from the gasifier feed via line 706 to syngas.

The raw syngas via line 711 can contain 90% or more carbon monoxide and hydrogen, 95% or more carbon monoxide and hydrogen, 97% or more carbon monoxide and hydrogen, or 99% or more carbon monoxide and hydrogen. The carbon monoxide content of the raw syngas via line 711 produced in the gasifier 710 can range from a low of about 10 vol %, about 20 vol %, or about 30 vol % to a high of about 60 vol %, about 70 vol %, about 80 vol %, or about 90 vol %. For example, carbon monoxide content of the raw syngas via line 711 can range from about 15 vol % to about 85 vol %, about 25 vol % to about 75 vol %, or about 35 vol % to about 65 vol %.

The hydrogen content of the raw syngas via line 711 can range from a low of about 1 vol %, about 5 vol %, or about 10 vol % to a high of about 30 vol %, about 40 vol %, or about 50 vol %. For example, the hydrogen content of the raw syngas via line 711 can range from about 5 vol % to about 45 vol % hydrogen, from about 10 vol % to about 35 vol % hydrogen, or from about 10 vol % to about 25 vol % hydrogen.

The raw syngas via line 711 can contain less than 25 vol %, less than 20 vol %, less than 15 vol %, less than 10 vol %, or less than 5 vol %, of combined nitrogen, methane, carbon dioxide, water, hydrogen sulfide, and hydrogen chloride.

The nitrogen content of the raw syngas via line 711 can range from a low of about 0 vol %, about 0.5 vol %, about 1.0 vol %, or about 1.5 vol % to a high of about 2.0 vol %, about 2.5 vol %, or about 3.0 vol %. The raw syngas via line 711 can be nitrogen-free or essentially nitrogen-free, e.g., containing 0.5 vol % nitrogen or less.

The methane content of the raw syngas via line 711 can range from a low of about 0 vol %, about 2 vol %, or about 5 vol % to a high of about 10 vol %, about 15 vol %, or about 20 vol %. For example, the methane content of the raw syngas via line 711 can range from about 1 vol % to about 20 vol %, from about 5 vol % to about 15 vol %, or from about 5 vol % to about 10 vol %. In another example, the methane content of the raw syngas via line 711 can be about 15 vol % or less, 10 vol % or less, 5 vol % or less, 3 vol % or less, 2 vol % or less, or 1 vol % or less.

The carbon dioxide content of raw syngas via line 711 can range from a low of about 0 vol %, about 5 vol %, or about 10 vol % to a high of about 20 vol %, about 25 vol %, or about 30 vol %. For example, the carbon dioxide content of raw syngas via line 711 can be about 20 vol % or less, about 15 vol % or less, about 10 vol % or less, about 5 vol % or less, or about 1 vol % or less.

The water content of the raw syngas via line 711 can be about 40 vol % or less, 30 vol % or less, 25 vol % or less, 20 vol % or less, 15 vol % or less, 10 vol % or less, 5 vol % less, 3 vol % or less, 2 vol % or less, or 1 vol % or less.

The raw syngas via line 711 leaving the gasifier 710 can have a heating value, corrected for heat losses and dilution effects, of about 1,863 kJ/m$^3$ (50 Btu/scf) to about 2,794 kJ/m$^3$ (75 Btu/scf); about 1,863 kJ/m$^3$ to about 3,726 kJ/m$^3$ (100 Btu/scf); about 1,863 kJ/m$^3$ to about 4,098 kJ/m$^3$ (110 Btu/scf); about 1,863 kJ/m$^3$ to about 5,516 kJ/m$^3$ (140 Btu/scf); about 1,863 kJ/m$^3$ to about 6,707 kJ/$^3$ (180 Btu/scf); about 1,863 kJ/m$^3$ to about 7,452 kJ/m$^3$ (200 Btu/scf); about 1,863 kJ/m$^3$ to about 9,315 kJ/m$^3$ (250 Btu/scf); about 1,863 kJ/m$^3$ to about 10,246 kJ/m$^3$ (275 Btu/scf), 1,863 kJ/m$^3$ to about 11,178 kJ/m$^3$ (300 Btu/scf), or about 1,863 kJ/m$^3$ to about 14,904 kJ/m$^3$ (400 Btu/scf).

The raw syngas via line 711 can exit the gasifier 710 at a temperature ranging from about 575° C. to about 2,100° C. For example, the raw syngas via line 711 can have a temperature ranging from a low of about 800° C., about 900° C., about 1,000° C., or about 1,050° C. to a high of about 1,150° C., about 1,250° C., about 1,350° C., or about 1,450° C.

The raw syngas via line 711 can be introduced to the syngas cooler 715 to provide a cooled syngas via line 716. The raw syngas via line 711 can be cooled in the syngas cooler 715 using a heat transfer medium introduced via line 714. For example, the raw syngas via line 711 can be cooled by indirect heat exchange of from about 260° C. to about 430° C. Although not shown, the heat transfer medium via line 714 can include process steam or condensate from syngas purification systems. The heat transfer medium via line 714 can be process water, boiler feed water, superheated low-pressure steam, superheated medium pressure steam, superheated high-pressure steam, saturated low-pressure steam, saturated medium pressure steam, saturated high-pressure steam, and the like. Heat from the raw syngas introduced via line 711 to the syngas cooler 715 can be indirectly transferred to the heat transfer medium introduced via line 714. For example, heat from the raw syngas introduced via line 714 to the syngas cooler 715 can be indirectly transferred to boiler feed water introduced via line 714 to provide superheated high pressure steam via line 717. The superheated or high pressure superheated steam via line 717 can be used to power one or more steam turbines (not shown) that can drive a directly coupled electric generator (not shown). Condensate recovered from the steam turbines (not shown) can then be recycled as the heat transfer medium via line 714, e.g., boiler feed water, to syngas cooler 715.

The superheated or high pressure superheated steam via line 717 from the syngas cooler 715 can be at a temperature ranging from a low of about 300° C., about 325° C., about 350° C., about 370° C., about 390° C., about 415° C., about 425° C., or about 435° C. to a high of about 440° C., about 445° C., about 450° C., about 455° C., about 460° C., about 470° C., about 500° C., about 550° C., about 600° C., or about 650° C. For example, the superheated or high pressure superheated steam via line 717 can be at a temperature of from about 427° C. to about 454° C., about 415° C. to about 433° C., about 430° C. to about 460° C., or about 420° C. to about 455° C. The superheated or high pressure superheated steam via line 717 can be at a pressure ranging from a low of about 3,000 kPa, about 3,500 kPa, about 4,000 kPa, or about 4,300 kPa to a high of about 4,700 kPa, about 5,000 kPa, about 5,300 kPa, about 5,500 kPa, about 6,000 kPa, or about 6,500 kPa. For example, the superheated or high pressure superheated steam via line 717 can be at a pressure of from about 3,550 kPa to about 5,620 kPa, about 3,100 kPa to about 4,400 kPa, about 4,300 kPa to about 5,700 kPa, or about 3,700 kPa to about 5,200.

Although not shown, the syngas cooler 711 can include one or more heat exchangers or heat exchanging zones arranged in parallel or in series. The heat exchangers included in the syngas cooler 711 can be shell-and-tube type heat exchangers. For example, the raw syngas via line 711 can be supplied in series or parallel to the shell-side or tube-side of the heat exchangers. The heat transfer medium via line 714 can pass through either the shell-side or tube-side, depending on which side the raw syngas is introduced.

The cooled syngas via line 716 can be introduced to the one or more particulate removal systems 720 to partially or completely remove particulates from the cooled syngas via line 716 to provide a separated or "particulate-lean" syngas via line 721, separated particulates via line 722, and condensate via line 723. Although not shown, steam can be supplied during startup to the particulate removal system 720.

Although not shown, the one or more particulate removal systems 720 can optionally be used to partially or completely remove particulates from the raw syngas via line 711 before cooling. For example, the raw syngas via line 711 can be introduced directly to the particulate removal system 720, resulting in hot gas particulate removal (e.g., from about 550° C. to about 1,050° C.). Although not shown, two particulate removal systems 720 can be used. For example, one particulate removal system 720 can be upstream of the syngas cooler 715 and one particulate removal system 720 can be downstream of the syngas cooler 715.

The one or more particulate removal systems 720 can include one or more separation devices such as conventional disengagers and/or cyclones (not shown). Particulate control devices ("PCD") capable of providing an outlet particulate concentration below the detectable limit of about 0.1 ppmw can also be used. Illustrative PCDs can include, but are not limited to, sintered metal filters, metal filter candles, and/or ceramic filter candles (for example, iron aluminide filter material). A small amount of high-pressure recycled syngas can be used to pulse-clean the filters as they accumulate particulates from the unfiltered syngas.

Although not shown, the ash in line 722 can be introduced to the heat exchange system 300 with the fine ash in line 722. Although not shown, in another example, the ash via line 722 can be introduced to another or separate heat exchange system 300.

Figure 8:
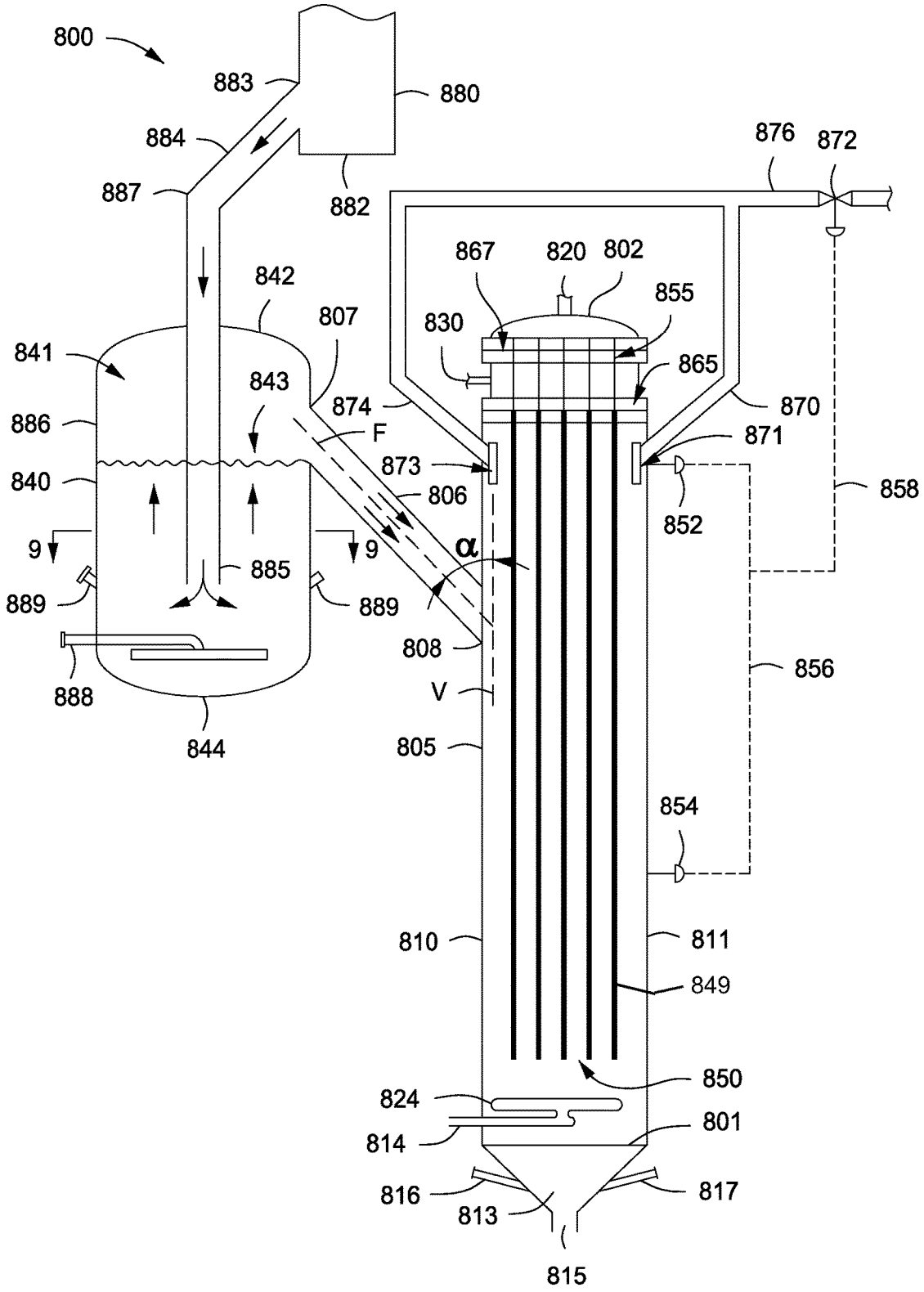
FIG. 8 depicts a schematic view of another illustrative heat exchange system, according to one or more embodiments described.

FIG. 8 depicts a schematic view of another illustrative heat exchange system 800, according to one or more embodiments. The heat exchange system 800 can include one or more fluidized bed coolers 886 and one or more heat exchangers 805. The one or more fluidized bed coolers 886 and be coupled to or in fluid communication with the one or more heat exchangers 805 and one or more gasifiers 880. For example, the fluidized bed cooler 886 can be downstream of and in fluid communication with the gasifier 880 and upstream of and in fluid communication with the heat exchanger 805.

The gasifier 880 can be coupled to or in fluid communication with a particulate removal line 884. The particulate removal line 884 can include a first end coupled to the gasifier 880 and a second end coupled to the fluidized bed cooler 886. The particulate removal line 884 can be coupled to the gasifier 880 at any location thereof or can be located at any point along the sidewall of the gasifier 880. For example, the particulate removal line 884 can be located at a height on the housing of the gasifier 880 closer to a bottom end 882 than a top end (not shown). The particulate removal line 884 can also be coupled to the gasifier 880 at a lower end thereof. For example, the particulate removal line 884 can be coupled to the gasifier 880 proximate the bottom end 882. The particulate removal line 884 can have an upper end 883 and a lower end 885. The particulate removal line 884 can contain an elbow 887 disposed between the upper end 883 and a lower end 885. The lower end 885 can be coupled to the fluidized bed cooler 886 so that the gasifier 880 and the particulate removal line 884 can be in fluid communication with the fluidized bed cooler 886. The lower end 885 can also be disposed on or within the fluidized bed cooler 886.

The fluidized bed cooler 886 can include an inner wall or surface 840, an open (not shown) or enclosed first or "top" end 842, and an enclosed second or "bottom" end 844. The inner wall or surface 840 can be a single component or structure or can be made of two or more components or structures assembled together. The fluidized bed cooler 886 can have any desired inner cross-sectional shape that can be, rectangular, elliptical, circular, oval, or any combination thereof. Depending, at least in part, on the configuration of the inner surface 840, the inner surface 840 can form or define, at least in part, an internal volume or "first internal volume" 841. For example, the inner surface 840 can form or define an internal volume 841 having a cylindrical, spherical, ellipsoidal, spheroidal (e.g., prolate or oblate), and/or frusto-conical configuration or shape. The particulate removal line 884 can be positioned at or near the first end 842 and in fluid communication with the internal volume 841. Alternatively, the particulate removal line 884 can be positioned intermediate the first end 842 and the second end 844 and in fluid communication with the internal volume 841.

A longitudinal axis of the fluidized bed cooler 886 can be vertically oriented or oriented at an angle with respect to vertical of between about 1°, about 5°, about 10°, about 20°, or about 30° and about 60°, about 70°, or about 80°. The fluidized bed cooler 886 or a longitudinal axis of the fluidized bed cooler 886 can be at least substantially vertically oriented. As used herein, the term "substantially vertical" refers to about −20 degrees to about 20 degrees, about −15 degrees to about 15 degrees, about −10 degrees to about −10 degrees, about −5 degrees to about −5 degrees, about −3 degrees to about 3 degrees, about −2 degrees to about 2 degrees, about −1 degree to about 1 degree, about −0.1 degree to about 0.1 degree, or about −0.0001 degree to about 0.0001 degree with respect to vertical.

At least a portion of the particulate removal line 884 can be disposed within the internal volume 841 of the fluidized bed cooler 886. The lower end 885 of the particulate removal line 884 can also be disposed within the fluidized bed cooler 886 at any location. For example, the lower end 885 can be disposed at a height between the first end 842 and the second end 844. A dense bed of fluidized solids can be disposed within the internal volume 841 off the fluidized bed cooler 886. The lower end 885 of the particulate removal line 884 can be positioned under the upper surface or level 843 of the dense bed of fluidized solids disposed within the internal volume 841. The level 843 can positioned within the volume 841 at any height intermediate the first end 842 and the lower end 885 of the particulate removal line 884. The lower end 885 can be disposed from about 1 cm, about 5 cm, about 10 cm, about 25 cm, about 100 cm to about 200 cm, about 350 cm, about 500 cm, about 750 cm, about 1,000 cm or more below the level 843 of the dense bed of fluidized solids. The lower end 885 can be disposed from about 1 cm, about 5 cm, about 10 cm, about 25 cm, about 100 cm to about 200 cm, about 350 cm, about 500 cm, about 750 cm, about 1,000 cm or more above the second end 844 of the fluidized bed cooler 886.

The fluidized bed cooler 886 can include one or more water injection nozzles 889 disposed on or through the inner surface 840 for injecting water into the internal volume 841. Any number of water injection nozzles 889 (two are shown) can be disposed on the inner surface 840. For example, at least 2, 3, 4, 6, 8, 10 or more water injection nozzles 889 can be disposed on the inner surface 840. The water injection nozzle 889 can be disposed at or near the lower end 885 of the particulate removal line 884. For example, the water injection nozzle 889 can terminate into the fluidized bed cooler 886 at the same height within fluidized bed cooler 886 as the lower end 885 of the particulate removal line 884. The water injection nozzle 889 can be disposed below the lower end 885 of the particulate removal line 884. For example, the water injection nozzle 889 can be disposed at least about 5 cm, at least about 10 cm, at least about 15 cm, at least about 20 cm, at least about 30 cm, at least about 40 cm, at least about 50 cm, or at least about 1 m below the lower end 885 of the particulate removal line 884. The water injection nozzle 889 can be disposed above the lower end 885 of the particulate removal line 884. For example, the water injection nozzle 889 can be disposed at least about 5 cm, at least about 10 cm, at least about 15 cm, at least about 20 cm, at least about 30 cm, at least about 40 cm, at least about 50 cm, or at least about 1 m above the lower end 885 of the particulate removal line 884.

The water injection nozzle 889 can be disposed at any angle such that the aeration nozzle can direct air, particulates, and/or fluid toward the lower end 885. For example, the water injection nozzle 889 can be disposed at an angle in a direction toward the second end 844 from a low of about 30°, about 40°, or 50° to a high of about 70°, about 80°, or about 90° with respect to the axial direction. The water injection nozzle 889 can also be disposed at an angle in a direction toward the second end 844 from about 35° to about 85° or from about 45° to about 75° from the axial direction. The water injection nozzle 889 can also be disposed at an angle in a direction toward the second end 844 of about 55°, about 60°, or about 65° from the axial direction. In another example, the water injection nozzle 889 can be disposed at an angle in a direction toward the second end 844 from a low of about 30°, about 40°, or 50° to a high of about 70°, about 80°, or about 90° with respect to the axial direction. The water injection nozzle 889 can also be disposed at an angle in a direction toward the second end 844 from about 35° to about 85° or from about 45° to about 75° from the axial direction. The water injection nozzle 889 can also be disposed at an angle in a direction toward the second end 844 of about 55°, about 60°, or about 65° from the axial direction.

At least one aerator or aeration gas supply conduit 888 can be disposed through the inner surface 840 near the second end 844 of the fluidized bed cooler 886. The aerator 888 can be disposed at a distance beneath the lower end 885 of the particulate removal line 884 sufficient to reduce or prevent erosion of particulate removal line 884 from the aeration gas exiting the aerator 888. For example, the aerator 888 can be disposed at least about 15 cm, at least about 30 cm, at least about 60 cm, at least about 90 cm, at least about 120 cm, at least about 150 cm, at least about 2 m, or at least about 3 m below the lower end 885 of the particulate removal line 884. The aerator 888 can be disposed at any angle such that the aeration nozzle can direct air, particulates, and/or fluid toward the lower end 885. For example, the aerator 888 can be disposed at an angle from a low of about 30°, about 40°, or 50° to a high of about 70°, about 80°, or about 90° with respect to the axial direction. In another example, the aerator 888 can be disposed at an angle of from about 35° to about 85° or from about 45° to about 75° from the axial direction. In yet another example, the aerator 888 can be disposed at an angle of about 55°, about 60°, or about 65° from the axial direction. The aerator 888 can have an internal projection inside above the second end 844 of the fluidized bed cooler 886. The internal projection can be a tube having one or more perforations at an end that can be at least partially disposed inside the fluidized bed cooler 886. The aerator 888 can provide fluff air to provide for the fluidized bed.

A particulate transfer line 806 can be in fluid communication with the fluidized bed cooler 886. The transfer line 806 can include a first end 807 and a second end 808. The first end 807 of the particulate transfer line 806 can be coupled to the fluidized bed cooler 886 at any location. For example, the first end 807 of the particulate transfer line 806 can be disposed at a height between the first end 842 and the second end 844 of the fluidized bed cooler 886. The first end 807 of the particulate transfer line 806 can be positioned at a height at or near the level 843 of the dense bed of fluidized solids disposed within the internal volume 841. The first end 807 of the particulate transfer line 806 can be disposed at a height below the height of the level 843 of the dense bed of fluidized solids. For example, the first end 807 of the particulate transfer line 806 can be disposed from about 0.01 cm, about 0.1 cm, about 1 cm, about 5 cm, or about 10 cm to about 25 cm, about 35 cm, about 50 cm, about 75 cm, or about 100 cm below the level 843 of the dense bed of fluidized solids.

A centerline F through the transfer line 806 can be vertical V or oriented at an angle $\alpha$ with respect to vertical V from about 1°, about 5°, about 10°, about 20°, or about 30° to about 60°, about 70°, or about 80°. For example, the transfer line 806 can be oriented at an angle $\alpha$ between about 1° and about 80°, between about 20° and about 70°, about 30° and about 60°, or about 40° and about 50° with respect to vertical V.

The second end 808 of the transfer line 806 can be located at any point along the sidewall 811 of the heat exchanger 805. For example, second end 808 of the transfer line 806 can be located at a height on the housing 810 closer to the bottom end 801 than the top end 802. For example, the second end 808 of the transfer line 806 can be situated at a height closer to closed distal ends of the tube bundle 850 than to the first tube sheet 865. The transfer line 806 can be coupled to the same location on the heat exchanger 805 as the location of the particulate inlet 305 coupled to the housing 310 of the heat exchange system 300 as shown in FIG. 3. The transfer line 806 can also contain an aeration nozzle (not shown). The aeration nozzle can be positioned at any location along the transfer line 806 sufficient to aid the distribution of particulates down the transfer line 806 and to the heat exchanger 805.

The heat exchanger 805 can be or include the heat exchanger from the heat exchange system 300 depicted in FIG. 3. For example, the heat exchanger can include at least a portion of the heat exchange system 300. The heat exchanger 805 can include one or more particulate inlets 806, one or more particulate outlets 815, and one or more narrowing members 813. The heat exchange system 800 can also include one or more inlet manifolds (not shown), one or more outlet manifolds (not shown), and one or more heat exchange members or tube bundle 850. The heat exchange system 800 can also include a housing 810 having one or more sidewalls (one is shown 811), a top end 802, and a bottom end 801. The housing 810 can have a cylindrical shape and can have a size and shape sufficient to house a tube bundle 850.

The tube bundle 850 can be supported by one or more support members or one or more first tube sheets 865. The first tube sheet 865 can be connected to the tubulars 849 in any manner sufficient to support at least the entire weight of the combined tubulars 849 and to form a seal fluidly isolating the space above the first tube sheet 865 and the space below the first tube sheet 865. A plurality of inner conduits 855 can be supported by one or more second tube sheets 867. The second tube sheet 867 can be connected to the inner conduits 855 in any manner sufficient to support at least the entire weight of the combined inner conduits 855 and to form a seal fluidly isolating the space above the second tube sheet and the space below the second tube sheet.

At least one aeration nozzle 814 can be disposed through the sidewall 811 near the bottom end 801 of the housing 810. The aeration nozzle 814 can be disposed at a distance beneath the tube bundle 850 sufficient to reduce or prevent erosion of the tube bundle 850 from the aeration gas exiting the aeration nozzle 814. For example, the aeration nozzle 814 can be disposed at least about 15 cm, at least about 30 cm, at least about 60 cm, at least about 90 cm, at least about 120 cm, at least about 150 cm, at least about 2 m, or at least about 3 m below the lowermost end or closed distal end of the tube bundle 850. The aeration nozzle 814 can be disposed at any angle such that the aeration nozzle can direct air, particulates, and/or fluid toward the tube bundle 850. For example, the aeration nozzle 814 can be disposed at an angle from a low of about 30°, about 40°, or 50° to a high of about 70°, about 80°, or about 90° with respect to the axial direction. In another example, the aeration nozzle 814 can be disposed at an angle of from about 35° to about 85° or from about 45° to about 75° from the axial direction. In yet another example, the aeration nozzle 814 can be disposed at an angle of about 55°, about 60°, or about 65° from the axial direction. The aeration nozzle 814 can have an internal projection 824 inside above the bottom end 801 of the housing 810. The internal projection 824 can be a tube having one or more perforations at an end that can be at least partially disposed inside the housing 810. The aeration nozzle 814 can provide fluff air to get air and/or particulates flowing up toward the tube bundle 850.

A narrowing member 813 can be disposed at the bottom end 801 of the housing 810. The narrowing member 813 can be frustoconical or a cone, for example. The narrowing member 813 can have a particulate outlet 815 disposed on narrowest end of the narrowing member 813 for the removal of cooled particulates from the heat exchanger 805.

The narrowing member 813 can include one or more aeration nozzles (two are shown 816, 817) disposed in a sidewall thereof. The aeration nozzles 816, 817 can be disposed at any angle with respect to the housing and/or the axial direction such that aeration nozzles 816, 817 can direct a second aeration fluid toward the particulate outlet 815. For example, air, nitrogen, carbon dioxide, argon, or any combination thereof can be introduced as a second aeration fluid via nozzles 816, 817. The second aeration fluid can be an inert gas such as nitrogen. The second aeration fluid can also be or include air.

The aeration nozzles 816, 817 can be disposed at an angle from a low of about 30°, about 40°, or 50° to a high of about 70°, about 80°, or about 90° with respect to the axial direction. In another example, the aeration nozzles 816, 817 can be disposed at an angle of from about 35° to about 85° or from about 45° to about 75° from the axial direction. In yet another example, the aeration nozzles 816, 817 can be disposed at an angle of about 55°, about 60°, or about 65° from the axial direction.

Although not shown, the aeration nozzles 816, 817 can have an internal projection inside the narrowing member 813 of the housing 810. The internal projection can be a tube having one or more perforations at an end that can be at least partially disposed inside the narrowing member 813 of the housing 810. The aeration nozzles 816, 817 can provide fluff air to get air and/or cooled particulates flowing out through the particulate outlet 815.

The amount of aeration gas exiting the nozzle 814 can determine the size, density, and level of the dense bed of particulates in the heat exchanger 805. Aeration gas leaving the aeration nozzle 814 can first flow through the dense bed, second through the dilute bed from bottom to top, and third exit the housing 810 via a first aeration gas vent line 870 and a second aeration gas vent line 874 located at the top of the housing 810. In one or more embodiments, the flow of aeration gas can be only in one direction, upward from the aeration nozzle 814 disposed beneath the tube bundle 850 through the dense bed followed by the dilute bed and finally out of the housing 810 via lines 870 and 874. In one or more embodiments, the flow of hot particulates can be only in one direction, from the hot particulate inlet 808 to the housing 810 and from the housing 810 to the cooled particle outlet 815. The amount of aeration gas exiting the nozzle 814 can in part be determined by the amount of aeration gas leaving the housing 810 via lines 870 and 874. Lines 870 and 874 can merge into line 876. Line 876 can include a valve 872, which when closed can reduce or prevent aeration gas from leaving the housing 810. In addition, since the amount of aeration gas can be released from system 800 via lines 870 and 874, the amount of aeration gas exiting the nozzle 814 can help determine the level of the dense bed of particulates.

A pressure differential between the dense phase and the dilute phase can be monitored via pressure sensors 852 and 854. As depicted, pressure sensor 852 can be located in the dilute bed near the top of the housing 810 and the vent gas lines 870, 874. Pressure sensor 854 can be located in the dense bed near the particulate inlet 808. Pressure data observed via the pressure sensors 852, 854 can be transmitted via lines 856 and 858 used to control a control valve 872. The control valve 872 can be opened and closed based on the observed pressure differential in order to maintain a desired pressure differential in the housing 810 and thus maintain a desired height of the dense bed within the housing 810.

Lines 870 and 874 can include one or more separation devices such as conventional disengagers and/or cyclones (not shown). Particulate control devices ("PCD") capable of providing an outlet particulate concentration below the detectable limit of about 0.1 ppmw can also be used. Illustrative PCDs can include, but are not limited to, sintered metal filters, metal filter candles, and/or ceramic filter candles (for example, iron aluminide filter material). A small amount of high-pressure recycled syngas can be used to pulse-clean the filters as they accumulate particulates from the unfiltered syngas.

For example, the first aeration gas vent line 870 can be in fluid communication with a first filter 871 and the second aeration gas vent line 874 can be in fluid communication with a second filter 873. The first filter 871 and the second filter 873 can include iron aluminide material, ceramic material, stainless steel material, or the like. The first filter 871 and the second filter 873 can be disposed at any location in fluid communication with lines 870 and 874, respectively. For example, a terminating end of the first aeration gas vent line 870 can be coupled to or connected to the first filter 871 and a terminating end of the second aeration gas vent line 874 can be coupled to or connected to the second filter 873. The first and second filters 871, 873 can be disposed within the housing 810 of the heat exchanger 805. The first and second filters 871, 873 can also be disposed outside of the housing 810. The first and second filters 871, 873 can remove from about 50 wt %, about 60 wt %, or about 70 wt % to 80 wt %, about 95 wt %, or about 99.9 wt % of particulates in the purge aeration gas entering lines 870, 874, respectively.

Figure 9:
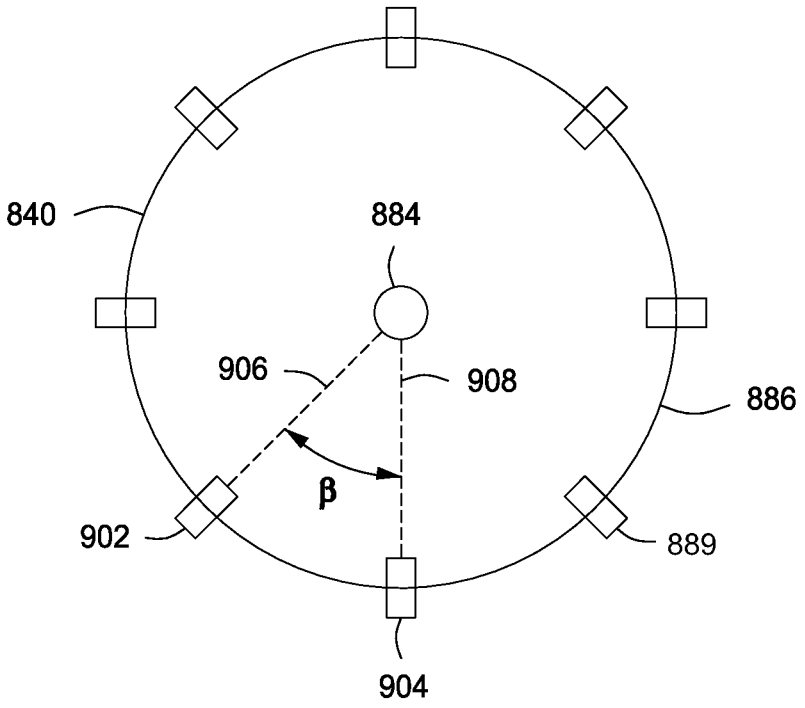
FIG. 9 depicts a cross-sectional view of a fluidized bed cooler depicted in FIG. 8 along line 9-9.

FIG. 9 depicts a cross-sectional view of a fluidized bed cooler 886 depicted in FIG. 8 along line 9-9, according to one or more embodiments. The particulate removal line 884 can be disposed within the fluidized bed cooler 886 at any location. The particulate removal line 884 can be disposed within the fluidized bed cooler 886 such that at least a portion of the particulate removal line 884 can be axially aligned with the fluidized bed cooler 886. For example, the particulate removal line 884 can be concentrically disposed within the fluidized bed cooler 886. The particulate removal line 884 can be axially offset (not shown) from the fluidized bed cooler 886.

A plurality of water injection nozzles 889 can be disposed along a circumference of the fluidized bed cooler 886. For example, the plurality of water injection nozzles 889 can be equally spaced apart and circumferentially offset from one another. At least 2, 4, 6, 8, 10, 12 or more water injection nozzles 889 (8 are shown) can be equally spaced apart and circumferentially offset from one another along a circumference of the fluidized bed cooler 886. For example, longitudinal centerlines 906 and 908 of any two adjacent nozzles 902 and 904, respectively, can form an angle, β. Angle β can be from about 1°, about 5°, about 10°, about 20°, or about 30° to about 60°, about 70°, or about 80°. For example, longitudinal centerlines 906, 908 of adjacent nozzles 902 and 904, respectively, can be oriented at an angle β between about 1° and about 70°, between about 5° and about 60°, between about 10° and about 50°, about 15° and about 40°, or about 20° and about 30° with respect to each other.

Referring to FIGS. 8 and 9 in operation, the gasifier 880 can gasify one or more carbonaceous feedstocks in the presence of one or more oxidants to produce a raw syngas. For example, the gasifier 880 can be or include the gasifier 710. The gasifier 880 can produce the raw syngas as discussed above, while waste from the gasifier 880, e.g., ash or coarse ash, can be removed via line 884. The separated particulates leaving the gasifier 880 via line 884 can have a particle diameter (or an average cross-sectional size) of about 300 μm or less, about 150 μm or less, about 100 μm or less, about 50 μm or less, or about 25 μm or less. The separated particulates via line 884 can be introduced to the fluidized bed cooler 886 to produce first cooled particulates. The separated particulates via line 884 can enter the fluidized bed cooler 886 at a temperature ranging from a low of about 400° C., about 500° C., about 550° C., about 600° C., about 650° C., about 700° C., about 750° C., or about 800° C. to a high of about 900° C., about 950° C., about 1,000° C., about 1,050° C., about 1,100° C., about 1,150° C., about 1,200° C., about 1,250° C., about 1,350° C., or about 1,400° C. For example, the separated particles via line 884 can enter the fluidized bed cooler 886 at a temperature from about 720° C. to about 1,500° C., from about 780° C. to about 1,350° C., from about 825° C. to about 1,300° C., from about 875° C. to about 1,225° C., from about 925° C. to about 1,125° C., from about 950° C. to about 1,075° C., or from about 975° C. to about 1,025° C.

The fluidized bed cooler 886 can be operated at temperatures from about 300° C., about 400° C., about 500° C., or about 600° C. to about 800° C., about 1,000° C., about 1250° C., about 1,400° C. The fluidized bed cooler 886 can be operated at pressures from about 500 kPa, about 1,000 kPa, about 1,500 kPa, about 2,000 kPa, or about 2,500 kPa to about 3,500 kPa, about 4,000 kPa, about 4,500 kPa, about 5,000 kPa or about 10,000 kPa. The fluidized bed cooler 886 can have a dense phase of particulates having an upper surface or level 843. The dense phase of particulates can have a density from about 150 kg/m$^3$, about 300 kg/m$^3$, about 500 kg/m$^3$, or about 750 kg/m$^3$ to about 1,000 kg/m$^3$, about 1,250 kg/m$^3$, or about 1,600 kg/m$^3$. The particulates can enter the fluidized bed cooler 886 via particulate removal line 884 at a flow rate from about 0.01 kg/m$^2$-s, about 0.1 kg/m$^2$-s, about 0.5 kg/m$^2$-s, about 1 kg/m$^2$-s, about 5 kg/m$^2$-s, about 10 kg/m$^2$-s, about 25 kg/m$^2$-s, about 50 kg/m$^2$-s, or about 100 kg/m$^2$-s to about 250 kg/m$^2$-s, about 350 kg/m$^2$-s, about 500 kg/m$^2$-s, about 750 kg/m$^2$-s, or about 1,000 kg/m$^2$-s. The particulates can have a residence time in the fluidized bed cooler 886 from about 10 seconds, about 30 seconds, about 60 seconds, about 120 seconds, about 240 seconds, or about 500 seconds to about 750 seconds, about 1,000 seconds, about 1,250 seconds, about 1,500 seconds, or about 2,000 seconds.

The water injected into nozzles 889 can be fresh water, purified water, process water, partially processed water, dirty water, other refinery water, other refinery waste water, salt water, or mixtures thereof. The water injected into nozzles 889 can include any suitable waste water, such as sour water, black water, slag containing water, ammonia containing water, hydrogen chloride and/or other acid containing water, sodium hydroxide and/or other base containing water, chemical wastewater, refinery water runoff, process water, tar containing water, or any mixture thereof. The water can be at a temperature from about 5° C., about 10° C., about 15° C., or about 20° C. to about 70° C., about 80° C., about 90° C., or more. For example, the water can be about 90% liquid phase, about 95% liquid phase, about 99% liquid phase, or about 993% liquid phase. The water can range from about 90% liquid phase to about 100% liquid phase, from about 93% liquid phase to about 97% liquid phase, or from about 96% liquid phase to about 99% liquid phase. The water can be injected into the fluidized bed cooler 886 via nozzles 889 at a flow rate from about 0.001 kg/m$^2$-s, about 0.01 kg/m$^2$-s, about 0.1 kg/m$^2$-s, about 0.5 kg/m$^2$-s, about 1 kg/m$^2$-s, about 5 kg/m$^2$-s, about 10 kg/m$^2$-s, about 25 kg/m$^2$-s, about 50 kg/m$^2$-s, about 100 kg/m$^2$-s to about 150 kg/m$^2$-s, about 200 kg/m$^2$-s, about 250 kg/m$^2$-s, about 300 kg/m$^2$-s, about 500 kg/m$^2$-s, or about 1,000 kg/m$^2$-s.

The aeration fluid injected into aerator 888 can include any gaseous phase material. For example, the aeration fluid injected into aerator 888 can include air, nitrogen, carbon dioxide, argon, or any combination thereof. The aeration fluid injected into aerator 888 can be an inert gas such as nitrogen. The aeration fluid injected into aerator 888 can also be or include air. The aeration fluid can be injected into the aerator 888 at temperatures from about 10° C., about 25° C., about 35° C., about 50° C., or about 75° C. to about 100° C., about 150° C., about 200° C., about 250° C., or about 300° C. The aeration fluid can be injected into the fluidized bed cooler 886 via aerator 888 at a flow rate from about 0.001 kg/m$^2$-s, about 0.01 kg/m$^2$-s, about 0.1 kg/m$^2$-s, about 0.5 kg/m$^2$-s, about 1 kg/m$^2$-s, about 5 kg/m$^2$-s, about 10 kg/m$^2$-s to about 25 kg/m$^2$-s, about 50 kg/m$^2$-s, about 75 kg/m$^2$-s, or about 100 kg/m$^2$-s.

The first cooled particulates leaving the fluidized bed cooler 886 via the particulate transfer line 806 can have a temperature ranging from a low of about 300° C., about 400° C., about 450° C., about 500° C., about 550° C., about 600° C., about 650° C., or about 700° C. to a high of about 800° C., about 850° C., about 900° C., about 950° C., about 1,000° C., about 1,050° C., about 1,100° C., about 1,150° C., about 1,200° C., or about 1,300° C. For example, first cooled particulates leaving the fluidized bed cooler 886 via the particulate transfer line 806 can be at a temperature from about 425° C. to about 1,250° C., from about 560° C. to about 975° C., from about 625° C. to about 925° C., from about 675° C. to about 875° C., from about 695° C. to about 825° C., from about 725° C. to about 815° C., or from about 740° C. to about 795° C.

The first cooled particulates entering the housing 810 via the particulate transfer line 806 can form a dense phase bed of fluidized particulates and a dilute phase bed of fluidized particulates situated above the dense phase bed. In one or more embodiments, the particulate transfer line 806 enters the housing at or below the dense phase surface. The dense phase can occupy up to about 10%, up to about 20%, up to about 30%, up to about 40%, up to about 50%, up to about 60%, up to about 70% of the interior height of the housing 810. The dilute phase can occupy up to about 30%, up to about 40%, up to about 50%, up to about 60%, up to about 70%, up to about 80%, up to about 90% of the interior height of the housing 810.

The first cooled particulates entering the heat exchanger 805 via the particulate transfer line 806 can be at the same pressure as that of the gasifier 880, the fluidized bed cooler 886 or both, and can vary from system to system. For example, the particulates can enter into the heat exchanger 805 at a pressure ranging from a low about 101 kPa, about 500 kPa, about 1,000 kPa, or about 1,500 kPa to a high of about 3,500 kPa, about 4,000 kPa, about 4,500, or about 5,000 kPa. In another example, the particulates can enter the heat exchanger 805 at a pressure of from about 250 kPa to about 4,750 kPa, about 750 kPa to about 4,250 kPa, or about 1,250 kPa to about 3,750 kPa.

Particulates leaving the heat exchanger 805 can have a temperature ranging from a low of about 100° C., about 110° C., about 120° C., about 130° C., about 140° C., about 150° C., about 160° C., or about 165° C. to a high of about 170° C., about 175° C., about 180° C., about 185° C., about 190° C., about 200° C., about 210° C., about 220° C., about 230° C., or about 240° C. For example, the particulates leaving the heat exchanger 805 can have a temperature of from about 145° C. to about 205° C., about 155° C. to about 195° C., or about 165° C. to about 185° C. In another example, particulates leaving the heat exchanger 805 can have a temperature of about 175° C., about 176° C., or about 177° C.

The particulates can have a residence time in the heat exchanger 805 ranging from a low of about 1 s, about 5 s, about 10 s, about 40 s, or about 80 s to a high of about 600 s, about 900 s, about 1,800 s, about 2,500 s, or about 5,000 s. For example, the particulates can have a residence time within the heat exchanger 805 ranging from about 15 seconds to about 1,150 seconds, about 45 seconds to about 850 seconds, or about 85 seconds to about 550 seconds. The particulates can be introduced to the heat exchanger 805 at a rate ranging from a low of about 0.01 kg/m$^2$-s, about 40 kg/m$^2$-s, or about 80 kg/m$^2$-s to a high of about 600 kg/m$^2$-s, about 800 kg/m$^2$-s, or about 1000 kg/m$^2$-s. For example, the particulates can be introduced via the particulate transfer line 806 to the heat exchanger 805 at a rate of about 0.01 kg/m$^2$-s to about 950 kg/m$^2$-s, about 45 kg/m$^2$-s to about 750 kg/m$^2$-s, or about 85 kg/m$^2$-s to about 550 kg/m$^2$-s.

The amount of aeration gas exiting the nozzle 814 can determine the size, density, and level of the dense bed of particulates. In one or more embodiments, aeration gas leaving the aeration nozzle 814 can first flow through the dense bed, second through the dilute bed from bottom to top, and third exit the housing 810 via lines 870 and 874 located at the top of the housing 810. In one or more embodiments, the flow of aeration gas can be only in one direction, upward from the aeration nozzle 814 disposed beneath the tube bundle 850 through the dense bed followed by the dilute bed and finally out of the housing 810 via lines 870 and 874. In one or more embodiments, the flow of first cooled particulates can be only in one direction, from the particulate transfer line 806 to the housing 810 and from the housing 810 to the cooled particle outlet 815. The amount of aeration gas exiting the nozzle 814 can in part be determined by the amount of aeration gas leaving the housing 810 via lines 870 and 874, which can be controlled by the valve 872. The control valve 872 can be opened and closed based on the observed pressure differential in order to maintain a desired pressure differential in the housing 810 and thus maintain a desired height of the dense bed within the housing 810.

Embodiments of the present disclosure further relate to any one or more of the following paragraphs:

1. A method for cooling particulates, comprising: introducing particulates and water to a first vessel to provide a fluidized bed of particulates; cooling the fluidized bed of particulates in the first vessel to obtain first cooled particulates; recovering the first cooled particulates from the first vessel; introducing the first cooled particulates to a heat exchanger comprising a plurality of tubulars; introducing a coolant to the plurality of tubulars; flowing the first cooled particulates through a shell side of the heat exchanger and contacting at least a portion of the first cooled particulates with the plurality of tubulars; recovering a heated coolant from the plurality of tubulars; and recovering second cooled particulates from a particulate outlet.

2. The method according to paragraph 1, wherein the heat exchanger comprises: a second vessel comprising an elongated shell having a first end, a second end, and one or more sidewalls; a shell side particulate inlet disposed in the one or more sidewalls for receiving the first cooled particulates; a shell side particulate outlet disposed adjacent the second end for discharging the second cooled particulates; a tube bundle comprising the plurality of tubulars disposed within the vessel, wherein the tubulars each have an open first end secured to a first tube sheet and a closed second end, and wherein an inner conduit is disposed within each of the tubulars, each inner conduit having an open first end secured to a second tube sheet and an open second end disposed adjacent to the closed second end of its respective tubular; a coolant inlet disposed adjacent the first end for receiving the coolant; and a coolant outlet disposed in the one or more sidewalls between the first tube sheet and the second tube sheet for discharging the heated coolant.

3. The method according to paragraphs 1 or 2, wherein the particulates comprise fine ash, coarse ash, or a combination thereof.

4. The method according to any one of paragraphs 1 to 3, wherein the particulates entering the first vessel are at temperatures from about 400° C. to about 1,400° C.

5. The method according to any one of paragraphs 1 to 4, wherein the first cooled particulates recovered from the first vessel are at temperatures from about 300° C. to about 1,200° C.

6. The method according to any one of paragraphs 1 to 5, wherein the particulates have a residence time in the first vessel ranging from about 10 s to about 2,000 s.

7. The method according to any one of paragraphs 1 to 6, wherein the second cooled particulates recovered from the particulate outlet are at temperatures from about 100° C. to about 240° C.

8. The method according to any one of paragraphs 1 to 7, wherein the first cooled particulates have a residence time in the heat exchanger ranging from about 10 s to about 1,800 s.

9. The method according to any one of paragraphs 1 to 8, further comprising introducing a first aeration gas into the first vessel below a surface or a dense phase of the fluidized bed of particulates.

10. The method according to paragraph 2, further comprising introducing a second aeration gas into the second vessel from the second end of the second vessel and toward the plurality of tubulars, wherein the second aeration gas is introduced into the vessel at a location at least about 15 cm below the closed distal ends of the plurality of tubulars, and wherein the first cooled particulates are introduced into the second vessel at a location at least about 30 cm above the closed distal ends of the plurality of tubulars.

11. The method according to paragraph 9, wherein the second vessel further comprises a narrowing member situated between the second end of the second vessel and the particulate outlet.

12. The method according to paragraph 10, further comprising introducing a third aeration gas into the vessel through one or more aeration nozzles disposed on a sidewall of the narrowing member, wherein the third aeration gas is directed toward the particulate outlet.

13. The method according to paragraph 8, further comprising venting the first aeration gas via an aeration gas vent line disposed on the one or more sidewalls and above the particulate inlet, wherein the aeration gas vent line comprises a control valve coupled to a first pressure sensor disposed on the one or more sidewalls at the height of the aeration gas vent line and a second pressure sensor disposed on the one or more sidewalls at the height of the particulate inlet.

14. The method according to paragraph 12, further comprising adjusting a height of the surface of a dense fluidized bed of particulates in the second vessel by controlling a flow rate of the second aeration gas, adjusting a position of the control valve, or a combination thereof.

15. A method for cooling particulates, comprising: gasifying a carbonaceous material in the presence of one or more oxidants to provide ash and a raw synthesis gas comprising hydrogen and carbon monoxide; introducing at least a portion of the ash and water to a first vessel to provide a first dense bed of particulates; cooling the first dense bed of particulates in the first vessel to obtain first cooled particulates; recovering the first cooled particulates from the first vessel; introducing at least a portion of the first cooled particulates to a second vessel comprising an elongated shell having a first end, a second end, and one or more sidewalls, wherein the first cooled particulates are introduced through a particulate inlet disposed in the one or more sidewalls and second cooled particulates exit the second vessel through a particulate outlet disposed on the second end; introducing a coolant to a tube bundle disposed within the second vessel, wherein the tube bundle comprises a plurality of tubulars, wherein the tubulars each have an open first end secured to a first tube sheet and a closed second end, wherein an inner conduit is concentrically placed within each of the tubulars, wherein the inner conduit has an open first end secured to a second tube sheet and an open second end disposed adjacent the closed second end, and wherein the coolant enters the tube bundle through a coolant inlet adjacent the first end; recovering a heated coolant from a coolant outlet disposed in the one or more sidewalls between the first tube sheet and the second tube sheet for discharging the heated coolant;

flowing the first cooled particulates through a shell side of the vessel resulting in a second dense bed of particulates and contacting the second dense bed of particulates with the tube bundle; introducing an aeration gas into the vessel from one or more aeration nozzles located within the second vessel between the second end and the tube bundle, wherein the aeration gas is directed toward the tube bundle; venting at least a portion of the aeration gas via an aeration gas vent line disposed on the one or more sidewalls at a location between the particulate inlet and the first tube sheet; and recovering second cooled particulates from the particulate outlet disposed on the second end of the second vessel.

16. The method according to paragraph 15, further comprising filtering particulates from the portion of the aeration gas entering the aeration gas vent line with a sintered metal filter.

17. The method according to paragraphs 15 or 16, wherein the ash entering the first vessel is at temperatures from about 400° C. to about 1,400° C., and wherein the first cooled particulates leaving the first vessel are at temperatures from about 300° C. to about 1,200° C.

18. The method according to any one of paragraphs 15 to 17, wherein the first cooled particulates entering the second vessel are at temperatures from about 300° C. to about 1,200° C., and wherein the second cooled particulates leaving the second vessel are at temperatures from about 100° C. to about 240° C.

19. A system for cooling particulates, comprising: a gasifier in fluid communication with a raw syngas line and a particulate removal line; a first vessel in fluid communication with the particulate removal line, the first vessel comprising one or more water injection nozzles and one or more first aeration nozzles; a particulate transfer line in fluid communication with the first vessel and a second vessel, the second vessel comprising: an elongated shell having a first end, a second end, and one or more sidewalls; a shell side particulate inlet in fluid communication with the particulate transfer line and disposed in the one or more sidewalls for receiving particulates; a shell side particulate outlet disposed adjacent the second end for discharging cooled particulates, wherein a narrowing member is situated between the second end and the particulate outlet; a tube side fluid inlet adjacent the first end for receiving a coolant; a tube bundle comprising a plurality of tubulars, wherein the tubulars each have an open first end secured to a first tube sheet and a closed second end, and wherein an inner conduit is concentrically placed within each of the tubulars, the inner conduit having an open first end secured to a second tube sheet and an open second end disposed adjacent to the closed second end; a coolant outlet disposed in the one or more sidewalls between the first tube sheet and the second tube sheet for discharging heated coolant and a coolant inlet disposed adjacent to the first end for receiving coolant; one or more second aeration nozzles disposed between the second end of the vessel and the tube bundle for directing a second aeration fluid toward the tube bundle; and one or more third aeration nozzles disposed on a sidewall of the narrowing member for directing a third aeration gas toward the particulate outlet.

20. The system according to paragraph 19, further comprising: an aeration gas vent line disposed on the one or more sidewalls at a location between the particulate inlet and the first end of the vessel; a sintered metal filter disposed on the aeration gas vent line; a control valve in fluid communication with the aeration gas vent line and coupled to a first pressure sensor disposed on the one or more sidewalls at a height of the aeration gas vent line; and a second pressure sensor disposed on the one or more sidewalls adjacent the particulate inlet.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof' is determined by the claims that follow.

What is claimed is:

1. A method for cooling particulates, comprising:

introducing particulates and water to a first vessel to provide a fluidized bed of particulates;

cooling the fluidized bed of particulates in the first vessel to obtain first cooled particulates;

recovering the first cooled particulates from the first vessel;

introducing the first cooled particulates to a heat exchanger comprising a plurality of tubulars;

introducing a coolant to the plurality of tubulars;

flowing the first cooled particulates through a shell side of the heat exchanger and contacting at least a portion of the first cooled particulates with the plurality of tubulars;

recovering a heated coolant from the plurality of tubulars; and recovering second cooled particulates from a particulate outlet.

2. The method of claim 1, wherein the heat exchanger comprises:

a second vessel comprising an elongated shell having a first end, a second end, and one or more sidewalls;

a shell side particulate inlet disposed in the one or more sidewalls for receiving the first cooled particulates;

a shell side particulate outlet disposed adjacent the second end for discharging the second cooled particulates;

a tube bundle comprising the plurality of tubulars disposed within the vessel, wherein the tubulars each have an open first end secured to a first tube sheet and a closed second end, and wherein an inner conduit is disposed within each of the tubulars, each inner conduit having an open first end secured to a second tube sheet and an open second end disposed adjacent to the closed second end of its respective tubular;

a coolant inlet disposed adjacent the first end for receiving the coolant; and a coolant outlet disposed in the one or more sidewalls between the first tube sheet and the second tube sheet for discharging the heated coolant.

3. The method of claim 1, wherein the particulates comprise fine ash, coarse ash, or a combination thereof.

4. The method of claim 1, wherein the particulates entering the first vessel are at temperatures from about 400° C. to about 1,400° C.

5. The method of claim 1, wherein the first cooled particulates recovered from the first vessel are at temperatures from about 300° C. to about 1,200° C.

6. The method of claim 1, wherein the particulates have a residence time in the first vessel ranging from about 10 s to about 2,000 s.

7. The method of claim 1, wherein the second cooled particulates recovered from the particulate outlet are at temperatures from about 100° C. to about 240° C.

8. The method of claim 1, wherein the first cooled particulates have a residence time in the heat exchanger ranging from about 10 s to about 1,800 s.

9. The method of claim 1, further comprising introducing a first aeration gas into the first vessel below a surface of a dense phase of the fluidized bed of particulates.

10. The method of claim 2, further comprising introducing a second aeration gas into the second vessel from the second end of the second vessel and toward the plurality of tubulars, wherein the second aeration gas is introduced into the vessel at a location at least about 15 cm below the closed distal ends of the plurality of tubulars, and wherein the first cooled particulates are introduced into the second vessel at a location at least about 30 cm above the closed distal ends of the plurality of tubulars.

11. The method of claim 9, wherein the second vessel further comprises a narrowing member situated between the second end of the second vessel and the particulate outlet.

12. The method of claim 10, further comprising introducing a third aeration gas into the vessel through one or more aeration nozzles disposed on a sidewall of the narrowing member, wherein the third aeration gas is directed toward the particulate outlet.

13. The method of claim 8, further comprising venting the first aeration gas via an aeration gas vent line disposed on the one or more sidewalls and above the particulate inlet, wherein the aeration gas vent line comprises a control valve coupled to a first pressure sensor disposed on the one or more sidewalls at the height of the aeration gas vent line and a second pressure sensor disposed on the one or more sidewalls at the height of the particulate inlet.

14. The method of claim 12, further comprising adjusting a height of the surface of a dense fluidized bed of particulates in the second vessel by controlling a flow rate of the second aeration gas, adjusting a position of the control valve, or a combination thereof.

15. A method for cooling particulates, comprising:

gasifying a carbonaceous material in the presence of one or more oxidants to provide ash and a raw synthesis gas comprising hydrogen and carbon monoxide;

introducing at least a portion of the ash and water to a first vessel to provide a first dense bed of particulates;

cooling the first dense bed of particulates in the first vessel to obtain first cooled particulates;

recovering the first cooled particulates from the first vessel;

introducing at least a portion of the first cooled particulates to a second vessel comprising an elongated shell having a first end, a second end, and one or more sidewalls, wherein the first cooled particulates are introduced through a particulate inlet disposed in the one or more sidewalls and second cooled particulates exit the second vessel through a particulate outlet disposed on the second end;

introducing a coolant to a tube bundle disposed within the second vessel, wherein the tube bundle comprises a plurality of tubulars, wherein the tubulars each have an open first end secured to a first tube sheet and a closed second end, wherein an inner conduit is concentrically placed within each of the tubulars, wherein the inner conduit has an open first end secured to a second tube sheet and an open second end disposed adjacent the closed second end, and wherein the coolant enters the tube bundle through a coolant inlet adjacent the first end;

recovering a heated coolant from a coolant outlet disposed in the one or more sidewalls between the first tube sheet and the second tube sheet for discharging the heated coolant;

flowing the first cooled particulates through a shell side of the vessel resulting in a second dense bed of particulates and contacting the second dense bed of particulates with the tube bundle;

introducing an aeration gas into the vessel from one or more aeration nozzles located within the second vessel between the second end and the tube bundle, wherein the aeration gas is directed toward the tube bundle;

venting at least a portion of the aeration gas via an aeration gas vent line disposed on the one or more sidewalls at a location between the particulate inlet and the first tube sheet; and recovering second cooled particulates from the particulate outlet disposed on the second end of the second vessel.

16. The method of claim 15, further comprising filtering particulates from the portion of the aeration gas entering the aeration gas vent line with a sintered metal filter.

17. The method of claim 15, wherein the ash entering the first vessel is at temperatures from about 400° C. to about 1,400° C., and wherein the first cooled particulates leaving the first vessel are at temperatures from about 300° C. to about 1,200° C.

18. The method of claim 15, wherein the first cooled particulates entering the second vessel are at temperatures from about 300° C. to about 1,200° C., and wherein the second cooled particulates leaving the second vessel are at temperatures from about 100° C. to about 240° C.

* * * * *